US009829814B2

(12) United States Patent
Yoshida et al.

(10) Patent No.: US 9,829,814 B2
(45) Date of Patent: Nov. 28, 2017

(54) TONER

(71) Applicant: CANON KABUSHIKI KAISHA, Tokyo (JP)

(72) Inventors: Yu Yoshida, Mishima (JP); Yuhei Terui, Numazu (JP); Haruko Kubo, Susono (JP); Masashi Kawamura, Yokohama (JP); Yasuaki Murai, Kawasaki (JP); Takayuki Toyoda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/045,589

(22) Filed: Feb. 17, 2016

(65) Prior Publication Data

US 2016/0246192 A1 Aug. 25, 2016

(30) Foreign Application Priority Data

Feb. 25, 2015 (JP) ..... 2015-035616

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/0821* (2013.01); *G03G 9/0804* (2013.01); *G03G 9/08711* (2013.01); *G03G 9/091* (2013.01); *G03G 9/092* (2013.01); *G03G 9/0904* (2013.01); *G03G 9/0918* (2013.01)

(58) Field of Classification Search

CPC combination set(s) only.
See application file for complete search history.

(56) References Cited

U.S. PATENT DOCUMENTS

| | | | |
|---|---|---|---|
| 7,141,342 | B2 | 11/2006 | Toyoda et al. |
| 7,264,910 | B2 | 9/2007 | Toyoda et al. |
| 7,288,357 | B2 | 10/2007 | Toyoda et al. |
| 7,812,113 | B2 | 10/2010 | Deroover et al. |
| 7,833,685 | B2 | 11/2010 | Tanaka et al. |
| 8,211,606 | B2 | 7/2012 | Murai et al. |
| 8,377,616 | B2 | 2/2013 | Tani et al. |
| 8,628,899 | B2 | 1/2014 | Kawamura et al. |
| 8,815,484 | B2 | 8/2014 | Tanaka et al. |
| 8,916,319 | B2 | 12/2014 | Ikeda et al. |
| 8,940,467 | B2 | 1/2015 | Hashimoto et al. |
| 9,146,485 | B2 | 9/2015 | Tani et al. |
| 9,229,345 | B2 | 1/2016 | Ikeda et al. |
| 2010/0035171 | A1 | 2/2010 | Watanabe et al. |
| 2014/0080047 | A1 | 3/2014 | Takahashi et al. |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2015/0274853 | A1 | 10/2015 | Nishiura et al. |
| 2015/0277254 | A1 | 10/2015 | Mukumoto et al. |

FOREIGN PATENT DOCUMENTS

| | | | |
|---|---|---|---|
| JP | 2009-501254 | A | 1/2009 |
| JP | 2010-152208 | A | 7/2010 |
| JP | 2012-63559 | A | 3/2012 |
| JP | 2013-182059 | A | 9/2013 |
| JP | 2014-167602 | A | 9/2014 |
| WO | 99/42532 | A1 | 8/1999 |

*Primary Examiner* — Hoa V Le
(74) *Attorney, Agent, or Firm* — Fitzpatrick Cella Harper and Scinto

(57) ABSTRACT

A toner having a toner particle that contains a binder resin, a pigment, a pigment dispersant, and a crystalline polyester, wherein the pigment dispersant has a specific pigment adsorption segment and a polymer moiety and a hydrophobic parameter HP1 for the pigment dispersant and a hydrophobic parameter HP2 for the crystalline polyester satisfy the formula $-0.28 \leq (HP1-HP2) \leq 0.15$.

17 Claims, No Drawings

TONER

BACKGROUND OF THE INVENTION

Field of the Invention

The present invention relates to a toner used in image-forming methods such as electrophotographic methods, electrostatic recording methods, and toner jet methods.

Description of the Related Art

The demands on printers and so forth for size reduction and greater energy savings have been increasing in recent years. One approach to size reduction is to improve the tinting strength of the toner. Improving the tinting strength of a toner makes it possible to carry out image formation using less toner, and as a result the size of the toner container can be reduced.

Investigations have been carried out into enhancing the pigment dispersibility in order to improve the tinting strength of toner. Pigment dispersants having a segment adsorbed to the pigment and a polymer segment that exhibits a good intimacy with the dispersion medium for the pigment are in use as a means for enhancing the dispersibility of the pigment in a toner. WO 99/42532 describes an example that uses Solsperse (registered trademark) (The Lubrizol Corporation) as a comb-shaped polymeric dispersant that has an acidic or basic moiety. Japanese Patent Application Laid-open No. 2010-152208 describes an example that uses, as a polymeric pigment dispersant for toners, a dispersant in which an azo or bisazo chromophore having an acetoacetanilide substituent is bonded to a polymer. These realize toners that have high tinting strengths.

On the other hand, fixing at lower temperatures is a property required of a toner in order to achieve greater energy savings. Investigations have therefore been carried out into the use of crystalline polyester. Crystalline polyester has the property (sharp melt property) of undergoing almost no change in viscosity up to its melting point and then immediately softening all at once when its melting point is exceeded. The introduction of a crystalline material into a toner can bring about softening of the toner by the heat applied during fixing without causing the heat-resistant storability to deteriorate, and for this reason can be expected to enhance the fixing performance (low-temperature fixability) at low set temperatures. A toner that uses a crystalline polyester is proposed in Japanese Patent Application Laid-open No. 2014-167602, and this toner makes it possible for the low-temperature fixability to co-exist in good balance with the heat-resistant storability.

SUMMARY OF THE INVENTION

There has been demand in recent years for the tinting strength to be raised to even higher levels, and there is room to further raise the tinting strength of the toners described in WO 99/42532 and Japanese Patent Application Laid-open No. 2010-152208. In addition, in some cases the crystalline polyester-containing toner described in Japanese Patent Application Laid-open No. 2014-167602 has been prone to exhibit a decline in its fixing performance at high temperatures (hot offset resistance). Moreover, in some cases crystalline polyester-containing toners have exhibited a deterioration in charging performance and a resulting decline in the transfer efficiency in the transfer process.

The present invention provides a toner that solves the existing problems that are described above. Thus, an object of the present invention is to provide a toner for which a high level of tinting strength can co-exist in good balance with the low-temperature fixability, and that exhibits an excellent hot offset resistance and an excellent transferability.

The present invention relates to a toner having a toner particle that contains a binder resin, a pigment, a pigment dispersant, and a crystalline polyester, wherein the pigment dispersant has a structure represented by formula (1) and a polymer moiety and the hydrophobic parameter HP1 of the pigment dispersant and the hydrophobic parameter HP2 of the crystalline polyester satisfy the following formula, $$-0.28 \leq (HP1-HP2) \leq 0.15$$

[HP1 represents the volume fraction of heptane at the point at which the pigment dispersant precipitates when heptane is added to a solution containing 0.05 mass parts of the pigment dispersant and 1.48 mass parts of chloroform. HP2 represents the volume fraction of heptane at the point at which the crystalline polyester precipitates when heptane is added to a solution containing 0.05 mass parts of the crystalline polyester and 1.48 mass parts of chloroform.]

(1)

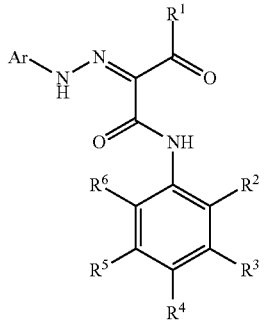

[in formula (1):

$R^1$ represents a substituted or unsubstituted alkyl group or a substituted or unsubstituted phenyl group;

Ar represents a substituted or unsubstituted aryl group;

Ar and $R^2$ to $R^6$ satisfy at least one of the following conditions (i) and (ii):

(i) Ar has a linking group that is bonded to a carbon atom in the aryl group and that forms a linking portion of bond to the polymer moiety, and (ii) at least one of $R^2$ to $R^6$ is a linking group that forms a linking portion of bond to the polymer moiety;

each of the $R^2$ to $R^6$ that is not a linking group independently represents a hydrogen atom, a halogen atom, an alkyl group, an alkoxy group, a hydroxyl group, an amino group, a cyano group, a trifluoromethyl group, a carboxyl group, or a group represented by the following formula (2-1) or a group represented by the following formula (2-2); and Ar and $R^2$ to $R^6$ satisfy at least one of the following conditions (iii) and (iv):

(iii) Ar has a group represented by formula (2-1) or a group represented by formula (2-2) as a substituent, and (iv) at least one of $R^2$ to $R^6$ is a group represented by formula (2-1) or a group represented by formula (2-2)]

(2-1)

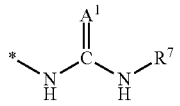

[in formula (2-1):

* represents a site where the group bonds to the Ar or the aromatic ring having $R^2$ to $R^6$ in formula (1);

$R^7$ represents a hydrogen atom, a substituted or unsubstituted alkyl group, an aralkyl group, a substituted or unsubstituted alkyloxycarbonyl group, or a substituted or unsubstituted aralkyloxycarbonyl group;

$A^1$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group]

(2-2)

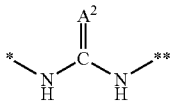

[in formula (2-2):

* and ** each represent a site where the group bonds to the Ar or the aromatic ring having $R^2$ to $R^6$ in formula (1);

the group represented by formula (2-2) forms a 5-membered heterocycle by bonding with the Ar or the aromatic ring having $R^2$ to $R^6$ in formula (1);

$A^2$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group].

The present invention can provide a toner for which a high level of tinting strength can co-exist in good balance with the low-temperature fixability, and that exhibits an excellent hot offset resistance and an excellent transferability.

Further features of the present invention will become apparent from the following description of exemplary embodiments.

DESCRIPTION OF THE EMBODIMENTS

The toner of the present invention has a toner particle that contains a binder resin, a pigment, a pigment dispersant, and a crystalline polyester.

As a result of intensive investigations, the present inventors discovered that effects are realized by a toner that contains a pigment dispersant and a crystalline polyester that satisfy the aforementioned range for the hydrophobic parameters wherein the pigment dispersant has a structure given by formula (1) (the pigment adsorption segment) and a polymer moiety.

The mechanism by which the effects are expressed is thought to be as follows. It is thought that, when a crystalline polyester is present at the surface of the toner particle, the release effects of the binder resin and release agent during fixing at high temperatures are impaired, and as a consequence paper wrap-around on fixing members and offset are then produced. In addition, from a structural standpoint crystalline polyester resists taking on a required charge during charging, and when it is present at the surface a satisfactory charging performance is then not obtained and the transferability may be reduced. It is predicted that the presence of crystalline polyester at the surface of the toner particle is suppressed in the present invention due to the following factors.

When there is a high affinity between the pigment dispersant and the crystalline polyester, it is thought that the pigment dispersant and the crystalline polyester can then readily exist in closer proximity in the toner. As a result, the crystalline polyester is immobilized around the circumference of the pigment through the intermediary of the pigment dispersant, and as a consequence the occurrence of the crystalline polyester at the toner surface is suppressed. It is thought that the affinity is raised by adjusting the hydrophobic parameters of the pigment dispersant and crystalline polyester and that the hot offset resistance and transferability are then enhanced through the actions described above.

However, when a conventional pigment dispersant is used, the adsorbability is low and a portion of the pigment adsorption segment may then end up being disengaged from the pigment. The disengaged pigment adsorption segment has a low affinity with crystalline polyester, and it is thought that a state is assumed in which localized close approach by the crystalline polyester to the pigment dispersant is impeded. Due to this, the crystalline polyester is presumably unable to become sufficiently immobilized around the circumference of the pigment. On the other hand, a high adsorbability is exhibited when the adsorption segment has the structure given by formula (1), and it is thought that as a consequence the indicated phenomena can be suppressed and the expression of the effects described herein is then achieved.

The pigment dispersant in the present invention has a pigment adsorption segment that exhibits a high adsorbability to pigment and has a polymer moiety that exhibits an elevated steric repulsion effect in order to prevent the pigment from aggregating. It is thought that a higher adsorbability by the pigment adsorption segment to a pigment increases the component that effectively acts for pigment dispersion.

The pigment adsorption segment of the pigment dispersant is specifically described in the following. The pigment adsorption segment characteristically has the structure given by the following formula (1).

(1)

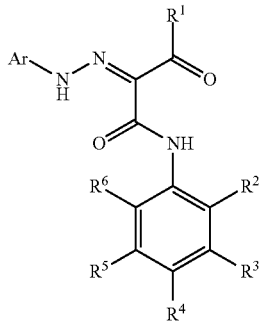

[in formula (1):

$R^1$ represents a substituted or unsubstituted alkyl group or a substituted or unsubstituted phenyl group;

Ar represents a substituted or unsubstituted aryl group;

Ar and $R^2$ to $R^6$ satisfy at least one of the following conditions (i) and (ii):

(i) Ar has a linking group that is bonded to a carbon atom in the aryl group and that forms a linking portion of bonding to the polymer moiety, and (ii) at least one of $R^2$ to $R^6$ is a linking group that forms a linking portion of bonding to the polymer moiety;

each of the $R^2$ to $R^6$ that is not a linking group independently represents a hydrogen atom, a halogen atom, an alkyl group (for example, $C_{1-4}$), an alkoxy group (for example, $C_{1-4}$), a hydroxyl group, an amino group, a cyano group, a trifluoromethyl group, a carboxyl group, a group represented by the following formula (2-1), or a group represented by the following formula (2-2); and Ar and $R^2$ to $R^6$ satisfy at least one of the following conditions (iii) and (iv):

(iii) Ar has a group represented by formula (2-1) or a group represented by formula (2-2) as a substituent, and (iv) at least one of $R^2$ to $R^6$ is a group represented by formula (2-1) or a group represented by formula (2-2)]

(2-1)

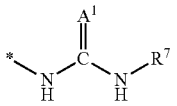

[in formula (2-1):

* represents a site where the group bonds to the Ar or the aromatic ring having $R^2$ to $R^6$ in formula (1);

$R^7$ represents a hydrogen atom, a substituted or unsubstituted alkyl group, an aralkyl group, a substituted or unsubstituted alkyloxycarbonyl group, or a substituted or unsubstituted aralkyloxycarbonyl group;

$A^1$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group]

(2-2)

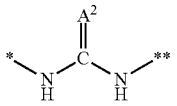

[in formula (2-2):

* and ** each represent a site where the group bonds to the Ar or the aromatic ring having $R^2$ to $R^6$ in formula (1);

the group represented by formula (2-2) forms a 5-membered heterocycle by bonding with the Ar or the aromatic ring having $R^2$ to $R^6$ in formula (1);

$A^2$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group].

The formula (1) of the present invention can assume tautomeric structures as in the following formulas, and these tautomers are also within the scope of the present invention.

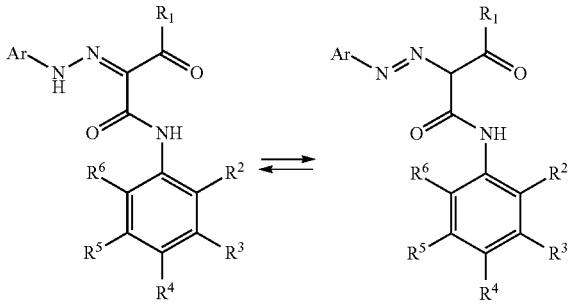

Formula (1) Formula (T1)

-continued

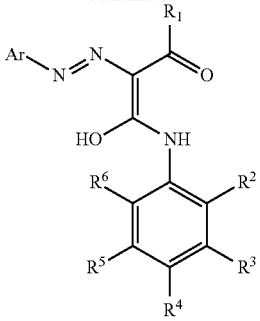

Formula (T2)

The presence of the above-described structure made it possible for a strong π-π interactivity to be exhibited and for a strong hydrogen bonding activity to be present and thus made possible a very high adsorption activity for a variety of pigments.

The alkyl group encompassed by $R^1$ in formula (1) can be exemplified by straight-chain, branched, and cyclic alkyl groups such as the methyl group, ethyl group, n-propyl group, n-butyl group, n-pentyl group, n-hexyl group, isopropyl group, isobutyl group, sec-butyl group, tert-butyl group, and cyclohexyl group.

The substituent for the substituted alkyl group and the substituent for the substituted phenyl group can be exemplified by halogen atoms, the nitro group, the amino group, the hydroxyl group, the cyano group, and the trifluoromethyl group. Among the preceding, $R^1$ in formula (1) is preferably the methyl group from the standpoint of the affinity for pigments. In the present invention, the halogen is a Group 17 element and can be exemplified by fluorine, chlorine, bromine, and iodine.

From the standpoint of the affinity for pigments, preferably at least one of $R^2$ to $R^6$ in formula (1) satisfies condition (ii). From the standpoint of the ease of production, more preferably at least one of $R^2$ to $R^6$ satisfies condition (ii) and each of the $R^2$ to $R^6$ that is not a linking group is a hydrogen atom.

The aryl group encompassed by Ar in formula (1) can be exemplified by the phenyl group and the naphthyl group.

The substituent on the substituted aryl group encompassed by Ar in formula (1) can be exemplified by halogen atoms, alkyl groups (for example, $C_{1-4}$), alkoxy groups (for example, $C_{1-4}$), the hydroxyl group, the amino group, the cyano group, the trifluoromethyl group, the carboxyl group, the group given by formula (2-1), and the group given by formula (2-2).

Among the preceding, and considering the affinity for pigments, the Ar in formula (1) preferably satisfies condition (iii). In addition, considered from the standpoint of the ease of production, more preferably at least one of the substituents on Ar is a group given by formula (2-1) or a group given by formula (2-2) and all of the other substituents are the hydrogen atom.

The alkyl group encompassed by the $R^7$ in formula (2-1) can be exemplified by straight-chain, branched, and cyclic alkyl groups such as the methyl group, ethyl group, n-propyl group, n-butyl group, n-pentyl group, n-hexyl group, isopropyl group, isobutyl group, sec-butyl group, tert-butyl group, and cyclohexyl group.

The aralkyl group encompassed by $R^7$ in formula (2-1) can be exemplified by the benzyl group and phenethyl group.

The alkyloxycarbonyl group encompassed by $R^7$ in formula (2-1) can be exemplified by the methoxycarbonyl group, ethoxycarbonyl group, n-propoxycarbonyl group, isopropoxycarbonyl group, n-butoxycarbonyl group, isobutoxycarbonyl group, sec-butoxycarbonyl group, tert-butoxycarbonyl group, n-pentyloxycarbonyl group, and n-hexyloxycarbonyl group.

The aralkyloxycarbonyl group encompassed by the $R^7$ in formula (2-1) can be exemplified by the benzyloxycarbonyl group and phenethyloxycarbonyl group.

The group given by formula (2-2) forms a 5-membered heterocycle by bonding to the Ar or the aromatic ring having $R^2$ to $R^6$ in formula (1). The 5-membered heterocycle formed here can be exemplified by the 2-imidazolone ring when $A^2$ in formula (2-2) is the oxygen atom, by the 2-imidazolidinethione ring when $A^2$ in formula (2-2) is the sulfur atom, and by the 2-iminoimidazolidine ring when $A^2$ in formula (2-2) is the NH group.

With reference to $R^7$, the substituent on the substituted alkyl group, the substituent on the substituted alkyloxycarbonyl group, and the substituent on the substituted aralkyloxycarbonyl group can be exemplified by halogen atoms, the nitro group, the amino group, the hydroxyl group, the cyano group, and the trifluoromethyl group.

Viewed in terms of the affinity for pigments, the $R^7$ in formula (2-1) is preferably a hydrogen atom, methyl group, or ethyl group among the preceding.

The alkyloxycarbonyl group encompassed by the $R^8$ in formula (2-1) and formula (2-2) can be exemplified by the same specific examples as provided above for the alkyloxycarbonyl group of $R^7$.

The aralkyloxycarbonyl group encompassed by the $R^8$ in formula (2-1) and formula (2-2) can be exemplified by the same specific examples as provided above for the aralkyloxycarbonyl group of $R^7$.

With reference to the $R^8$ in formula (2-1) and formula (2-2), the substituent on the substituted alkyloxycarbonyl group and the substituent on the substituted aralkyloxycarbonyl group can be exemplified by halogen atoms, the nitro group, the amino group, the hydroxyl group, the cyano group, and the trifluoromethyl group.

Among the preceding, the $R^8$ in the formula (2-1) and formula (2-2) is preferably the hydrogen atom, tert-butoxycarbonyl group, or benzyloxycarbonyl group from the standpoint of the ease of production.

The $A^1$ and $A^2$ in formula (2-1) and formula (2-2) can be any selection from the oxygen atom, sulfur atom, and $NR^8$ group, but are preferably the oxygen atom from the standpoint of the affinity for pigments and the ease of production.

The linking group for linking the structure with formula (1) and the polymer moiety should be a divalent linking group, but is not otherwise particularly limited. It can be exemplified by the ester bond (—COO—), thioester bond (—COS—), and carboxamide bond (—CONH—). The ester bond and carboxamide bond are preferred from the standpoint of the ease of production.

In specific terms, a linking group given by the following formula (L1) or (L2) is particularly preferred.

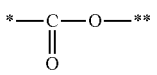

(L1)

-continued

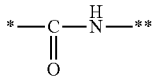

(L2)

[In formulas (L1) and (L2), * represents a site where the group bonds to a carbon atom in the polymer moiety and ** represents a site where the groups bonds to a carbon atom in an aromatic ring present in the structure given by formula (1).]

The instant pigment dispersant is characterized by having a polymer moiety. Steric hindrance is realized by the extension of the polymer chain of the polymer moiety in the pigment dispersion and pigment-to-pigment aggregation can then be prevented. It is thought that, due to this, the pigment can be uniformly dispersed in the toner particle and the tinting strength of the toner particle can therefore be increased.

It is thought that dispersibility and a strong adsorbability to pigment can be exhibited due to the presence of the polymer moiety and the pigment adsorption segment as described above, and that as a consequence the tinting strength can be increased.

A characteristic feature of the instant toner is that the hydrophobic parameter HP1 of the pigment dispersant and the hydrophobic parameter HP2 of the crystalline polyester satisfy the following formula.

$$-0.28 \leq (HP1-HP2) \leq 0.15$$

(HP1 denotes the volume fraction of heptane at the point of precipitation by the pigment dispersant as measured by the addition of heptane to a solution containing 0.05 mass parts of the pigment dispersant and 1.48 mass parts of chloroform.

HP2 denotes the volume fraction of heptane at the point of precipitation by the crystalline polyester as measured by the addition of heptane to a solution containing 0.05 mass parts of the crystalline polyester and 1.48 mass parts of chloroform.)

These hydrophobic parameters can be measured by the method described below. These hydrophobic parameters provide a numerical value for the degree of hydrophobicity of the pigment dispersant and the crystalline polyester, and it is thought that the affinity between the pigment dispersant and the crystalline polyester increases as the values of their hydrophobic parameters are closer to each other.

When (HP1−HP2) is from −0.28 to 0.15, the hot offset resistance and transferability are increased by the mechanism described above.

A more preferred range for (HP1−HP2) is $-0.25 \leq (HP1-HP2) \leq 0.13$.

HP1 can be controlled primarily by changing the composition of the polymer moiety in the pigment dispersant. HP2 can be controlled primarily by changing the composition of the crystalline polyester.

The structure given by formula (1) preferably is the structure given by the following formula (3).

(3)

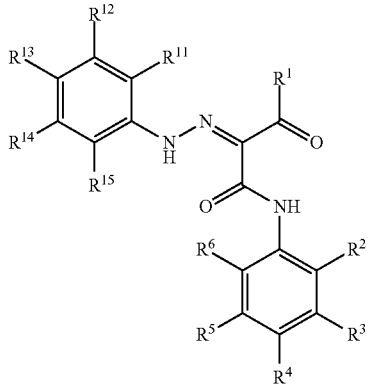

[In formula (3):

$R^1$ represents a substituted or unsubstituted alkyl group or a substituted or unsubstituted phenyl group;

$R^{11}$ to $R^{15}$ and $R^2$ to $R^6$ satisfy at least one of the following conditions (v) and (vi):

(v) at least one of $R^{11}$ to $R^{15}$ is a linking group that forms a linking portion of bonding to the polymer moiety, and (vi) at least one of $R^2$ to $R^6$ is a linking group that forms a linking portion of bonding to the polymer moiety;

each of the $R^{11}$ to $R^{15}$ and $R^2$ to $R^6$ that is not a linking group independently represents a hydrogen atom, a halogen atom, an alkyl group (for example, $C_{1-4}$), an alkoxy group (for example, $C_{1-4}$), a hydroxyl group, an amino group, a cyano group, a trifluoromethyl group, a carboxyl group, a group represented by the preceding formula (2-1), or a group represented by the preceding formula (2-2); and $R^{11}$ to $R^{15}$ and $R^2$ to $R^6$ satisfy at least one of the following conditions (vii) and (viii):

(vii) at least one of $R^{11}$ to $R^{15}$ is a group represented by the preceding formula (2-1) or a group represented by the preceding formula (2-2), and (viii) at least one of $R^2$ to $R^6$ is a group represented by the preceding formula (2-1) or a group represented by the preceding formula (2-2)].

An even higher adsorbability to the pigment is obtained when the structure with formula (1) is represented by formula (3), and as a result of this the tinting strength is increased.

The pigment dispersant preferably has a group represented by the following formula (4) in its molecule (preferably in the polymer moiety). The number of groups with formula (4) per molecule of the pigment dispersant is preferably from 2 to 10.

(4)

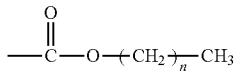

[The n in formula (4) represents an integer from 3 to 21.]

When the number of groups with formula (4) is 2 or more, an excellent affinity with the crystalline polyester is obtained and as a consequence the hot offset resistance and transferability are readily improved. When n is 3 or more, the hot offset resistance and transferability are also readily improved in the same manner. A loss of adsorbability to pigment is suppressed when the number of groups with formula (4) is not more than 10, and as a consequence the tinting strength is readily improved. The tinting strength is likewise readily improved in the same manner when n is not more than 21.

A more preferred range for the number of groups with formula (4) is from 3 to 9.

The number of groups with formula (4) can be controlled through adjustment of the monomer charge ratio during production of the polymer for the pigment dispersant.

The number of pigment adsorption segments (structure with formula (1)) per molecule of the pigment dispersant is preferably from 1 to 6. At 1 or more, the adsorbability to the pigment is improved and the tinting strength is then readily improved. At 6 or less, the tinting strength is readily improved because the interaction between adsorption segments can be reduced. A more preferred range for the number of pigment adsorption segments is from 2 to 5. The number of pigment adsorption segments can be controlled through adjustment of the monomer charge ratio and the molecular weight during production of the polymer segment for the pigment dispersant.

Any production method may be used in the present invention as the production method for producing the toner particle.

The following, for example, can be used: suspension polymerization methods, in which a polymerizable monomer composition containing the polymerizable monomer for producing the binder resin, the pigment, the pigment dispersant, the crystalline polyester, and as necessary a release agent and so forth, is suspended in an aqueous solvent and the polymerizable monomer is then polymerized; kneading pulverization methods, in which the constituent materials of the toner are kneaded, pulverized, and classified; emulsion aggregation methods, in which a dispersion prepared by emulsifying and dispersing the binder resin, a dispersion of the crystalline polyester, a dispersion of the pigment and pigment dispersant, and as necessary a dispersion of release agent and so forth, are mixed and aggregation and thermal melt-adhesion are carried out to obtain toner particles; emulsion polymerization and aggregation methods, in which a dispersion formed by the emulsion polymerization of the polymerizable monomer for the binder resin, a dispersion of the crystalline polyester, a dispersion of the pigment and pigment dispersant, and as necessary a dispersion of release agent and so forth, are mixed and aggregation and thermal melt-adhesion are carried out to obtain toner particles; and dissolution suspension methods, in which a solution of the binder resin, crystalline polyester, pigment, pigment dispersant, and as necessary release agent and so forth, is suspended and granulated in an aqueous solvent.

Among the preceding, a step is preferably present for the toner of the present invention in which the toner particle is obtained by granulation in an aqueous medium, and suspension polymerization methods and dissolution suspension methods are specifically more preferred for this step. When particles are formed by granulation in an aqueous medium, the crystalline polyester can then be better encapsulated and as a consequence the hot offset resistance and transferability are readily enhanced.

The polymer moiety here preferably has a monomer unit with the following formula (5).

(5)

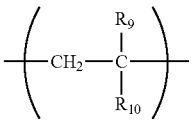

[In formula (5), $R_9$ represents a hydrogen atom or an alkyl group and $R_{10}$ represents a substituted or unsubstituted phenyl group, the carboxyl group, a substituted or unsubstituted alkoxycarbonyl group, or a substituted or unsubstituted carboxamide group.]

When the polymer moiety has a monomer unit with formula (5), the steric repulsion force is enhanced and the tinting strength is then readily increased.

The alkyl group encompassed by the $R_9$ in formula (5) is not particularly limited and can be exemplified by straight-chain, branched, and cyclic alkyl groups such as the methyl group, ethyl group, n-propyl group, n-butyl group, n-pentyl group, n-hexyl group, isopropyl group, isobutyl group, sec-butyl group, tert-butyl group, and cyclohexyl group.

Viewed from the perspective of the polymerizability of the polymerizable monomer that will form the monomer unit, the $R_9$ in formula (5) is preferably the hydrogen atom or the methyl group among the preceding.

The alkoxycarbonyl group encompassed by the $R_{1C}$ in formula (5) is not particularly limited and can be exemplified by straight-chain and branched alkoxycarbonyl groups such as the methoxycarbonyl group, ethoxycarbonyl group, n-propoxycarbonyl group, isopropoxycarbonyl group, n-butoxycarbonyl group, isobutoxycarbonyl group, sec-butoxycarbonyl group, tert-butoxycarbonyl group, octoxycarbonyl group, nonoxycarbonyl group, decoxycarbonyl group, undecoxycarbonyl group, dodecoxycarbonyl group, hexadecoxycarbonyl group, octadecoxycarbonyl group, eicosoxycarbonyl group, docosoxycarbonyl group, 2-ethylhexoxycarbonyl group, phenoxycarbonyl group, benzoxycarbonyl group, and 2-hydroxyethoxycarbonyl group.

The carboxamide group encompassed by $R_{1C}$ in formula (5) is not particularly limited and can be exemplified by straight-chain and branched amide groups such as the N-methylamide group, N,N-dimethylamide group, N-ethylamide group, N,N-diethylamide group, N-isopropylamide group, N,N-diisopropylamide group, N-n-butylamide group, N,N-di-n-butylamide group, N-isobutylamide group, N,N-diisobutylamide group, N-sec-butylamide group, N,N-di-sec-butylamide group, N-tert-butylamide group, N-octylamide group, N,N-dioctylamide group, N-nonylamide group, N,N-dinonylamide group, N-decylamide group, N,N-didecylamide group, N-undecylamide group, N,N-diundecylamide group, N-dodecylamide group, N,N-didodecylamide group, N-hexadecylamide group, N-octadecylamide group, N-phenylamide group, N-(2-ethylhexyl)amide group, and N,N-di(2-ethylhexyl)amide group.

With reference to the $R_{10}$ in formula (5), the substituent on the substituted phenyl group, the substituent on the substituted alkoxycarbonyl group, and the substituent on the substituted carboxamide group can be exemplified by the following groups: alkoxy groups such as the methoxy group and ethoxy group, amino groups such as the N-methylamino group and N,N-dimethylamino group, acyl groups such as the acetyl group, and halogen atoms such as the fluorine atom and chlorine atom.

The pigment preferably includes a pigment selected from the following group:

carbon black; C. I. Pigment Yellow 74, 93, 139, 155, 180, and 185; and C. I. Pigment Red 31, 122, 150, 170, 185, 258, and 269.

When the pigment is selected from this group, adsorption based on π-π interactions and hydrogen bonding activity operates even more strongly, and as a consequence the tinting strength, hot offset resistance, and transferability are readily improved. Carbon black; C. I. Pigment Yellow 155, 180, and 185; and C. I. Pigment Red 122 and 150 are even more preferred.

The crystalline polyester preferably has a condensate of a dibasic acid monomer given by the following formula (6) with a dihydric alcohol monomer given by the following formula (7)

$$HOOC—(CH_2)_m—COOH \quad \text{formula (6)}$$

(m in formula (6) is an integer from 4 to 12)

$$HO—(CH_2)_n—OH \quad \text{formula (7)}$$

(n in formula (7) is an integer from 4 to 12).

When m in formula (6) is at least 4 and n in formula (7) is at least 4, a higher affinity occurs between the crystalline polyester and the pigment dispersant and due to this the hot offset resistance and transferability are readily improved. When m is equal to or less than 12 and n is equal to or less than 12, a greater intimacy with the binder resin during fixing is readily obtained and the low-temperature fixability is readily improved.

The crystalline polyester in the present invention denotes a polyester for which a distinct endothermic peak (melting point) is observed in differential scanning calorimetric (DSC) measurement.

Even when a crystalline polyester has a graft or block configuration that has a crystalline segment and an amorphous segment, it still corresponds to a crystalline polyester when it has a distinct endothermic peak in differential scanning calorimetric (DSC) measurement.

A crystalline polyester usable by the present invention can be produced by the condensation polymerization of a diol with a dicarboxylic acid.

The dicarboxylic acid can be exemplified by alkanedicarboxylic acids (for example, succinic acid, adipic acid, pimelic acid, suberic acid, azelaic acid, sebacic acid, decanedicarboxylic acid, dodecanedicarboxylic, octadecanedicarboxylic acid, decylsuccinic acid, dodecylsuccinic acid, and octadecylsuccinic acid), alkenedicarboxylic acids (for example, maleic acid, fumaric acid, citraconic acid, mesaconic acid, dodecenylsuccinic acid, pentadecenylsuccinic acid, octadecenylsuccinic acid, and dimer acid), and aromatic dicarboxylic acids (for example, phthalic acid, isophthalic acid, terephthalic acid, and naphthalenedicarboxylic acid). These may be used in the form of the anhydride and the alkyl (for example, $C_{1-8}$) ester.

The diols can be exemplified by alkylene glycols (for example, ethylene glycol, 1,2-propylene glycol, 1,3-propylene glycol, 1,4-butanediol, 1,6-hexanediol, 1,7-heptanediol, 1,8-octanediol, 1,9-nonanediol, 1,10-decanediol, 1,12-dodecanediol, 1,14-tetradecanediol, neopentyl glycol, 2,2-diethyl-1,3-propanediol, 1,4-cyclohexanedimethanol, hydrogenated bisphenol A, and spiroglycol), alkylene ether glycols (for example, diethylene glycol, triethylene glycol, and dipropylene glycol), and bisphenols (bisphenol A, bisphenol F, bisphenol S, bisphenol A.2 mol ethylene oxide adduct, and bisphenol A.2.5 mol propylene oxide adduct).

A single dicarboxylic acid may be used by itself or a combination of two or more may be used; a single diol component may be used by itself or a combination of two or more may be used.

Among these dicarboxylic acids and diols, an alkanedicarboxylic acid and an alkylene glycol, which produce highly crystalline polyesters, are preferred.

An end-capping agent may be used with this crystalline polyester. The use of an end-capping agent makes it possible to adjust the molecular weight, acid value, hydroxyl value, crystallinity, and so forth of the crystalline polyester. The end-capping agent can be exemplified by monobasic acids and derivatives thereof and monohydric alcohols.

Specifically, the monobasic acids and derivatives thereof can be exemplified by acetic acid, propanoic acid, butanoic acid, pentanoic acid, hexanoic acid, heptanoic acid, octanoic acid, nonanoic acid, decanoic acid, lauric acid, stearic acid, benzoic acid, and the anhydrides of the preceding.

The monohydric alcohols can be exemplified by methanol, ethanol, propanol, butanol, pentanol, hexanol, heptanol, octanol, nonanol, decanol, lauryl alcohol, and stearyl alcohol.

As necessary, a known esterification catalyst, e.g., a tin compound or a titanium compound, may be used in the condensation polymerization reaction.

The crystalline polyester is preferably a resin (polymer) that has a polyester segment and a polystyrene segment. The compatibility with the binder resin during fixing is facilitated when a polystyrene segment is present, and due to this improvements to the low-temperature fixability are facilitated. In addition, the presence of the polystyrene segment facilitates a better encapsulation of the crystalline polyester, and due to this improvements in the hot offset resistance and transferability are facilitated.

The content of the polystyrene segment in the crystalline polyester is preferably from 10 mass % to 50 mass % in the crystalline polyester.

The polystyrene segment-containing crystalline polyester is produced by a known method or can be produced by the following method.

The polystyrene segment-containing crystalline polyester can be produced by the condensation polymerization of a diol, a dicarboxylic acid, and a carboxylic acid- or carboxylate ester-terminated vinyl polymer block. The carboxylic acid- or carboxylate ester-terminated vinyl polymer block can be introduced by known methods. The method of using a functional group-containing initiator can be exemplified by Journal of Polymer Science Part A: Polymer Chemistry, 1990, Volume 28, pp. 1887-1894. The method of using a functional group-containing chain transfer agent can be exemplified by Journal of Polymer Science Part A: Polymer Chemistry, 2000, Volume 38, pp. 3052-3058.

The content of the crystalline polyester is preferably from 0.5 mass % to 20 mass % with respect to the total of the binder resin and crystalline polyester. At 0.5 mass % and above, the effect of causing the toner to soften during fixing is readily expressed and the low-temperature fixability is then readily improved. At 20 mass % and below, the probability of the occurrence of the crystalline polyester at the surface is low and because of this improvements in the hot offset resistance and transferability are facilitated. The content of the crystalline polyester is more preferably from 3.0 mass % to 15 mass %.

The content of the pigment dispersant is preferably from 1.0 mass parts to 20 mass parts per 100 mass parts of the pigment. The effects on the tinting strength, hot offset resistance, and transferability readily occur at 1.0 mass parts and above. The use of 20 mass parts and below suppresses the increase in the amount of crystalline polyester not immobilized around the circumference of the pigment that is due to an increase in the pigment dispersant not adsorbed to the pigment, and as a consequence the hot offset resistance and transferability are then readily improved. The amount of the pigment dispersant with respect to the pigment is more preferably from 3.0 mass parts to 15 mass parts.

A known resin, e.g., a styrenic vinyl resin, maleic acid copolymer, polyester resin, or epoxy resin, can be used as the binder resin used in the toner of the present invention.

When the binder resin contains a styrene unit, the polymer moiety of the pigment dispersant preferably contains a styrene unit, and when the binder resin contains a polyester unit, the polymer moiety of the pigment dispersant preferably contains a polyester unit.

When the binder resin and the polymer moiety of the pigment dispersant both contain units that are structurally close to each other, the polymer chain of the polymer moiety can then undergo a better spatial extension and as a consequence a larger steric repulsion force occurs and the tinting strength is then readily increased.

Radical-polymerizable vinyl polymerizable monomers can be used for the polymerizable monomer that forms the styrenic vinyl resin.

The monofunctional polymerizable monomers can be exemplified by the following: styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

Multifunctional polymerizable monomers can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

A single monofunctional polymerizable monomer or a combination of two or more may be used; a monofunctional polymerizable monomer/multifunctional polymerizable monomer combination may be used; and a single multifunctional polymerizable monomer or a combination of two or more may be used.

Polybasic carboxylic acids and polyols can be used as the condensation-polymerizable monomer usable for the polyester resin.

The polybasic carboxylic acids can be exemplified by oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, hexahydroterephthalic acid, malonic acid, pimelic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid. Polybasic carboxylic acids other than dicarboxylic acids can be exemplified by trimellitic acid, pyromellitic acid, naphthalenetricarboxylic acid, naphthalenetetracarboxylic acid, pyrenetricarboxylic acid, and pyrenetetracarboxylic acid.

The polyol can be exemplified by ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, bisphenol A/ethylene oxide adduct, bisphenol A/propylene oxide adduct, hydrogenated bisphenol A, hydrogenated bisphenol A/ethylene oxide adduct, and hydrogenated bisphenol A/propylene oxide adduct.

In order to improve image quality, preferably an external additive is externally added to the toner particle for the toner of the present invention. An inorganic fine powder such as silica fine powder, titanium oxide fine powder, or aluminum oxide fine powder is favorably used as the external additive.

These inorganic fine powders are preferably subjected to a hydrophobic treatment with a hydrophobic agent such as a silane coupling agent, a silicone oil, or their mixture.

In addition, as necessary an external additive other than those indicated above may be mixed with the toner particle of the toner of the present invention.

The overall amount of addition of the inorganic fine powder is preferably from 1.0 mass parts to 5.0 mass parts per 100.0 mass parts of the toner particle (the toner particle prior to the addition of the external additive).

A method of producing the pigment dispersant of the present invention is described in detail in the following. This pigment dispersant can be synthesized according to heretofore known methods.

While a specific synthesis example is provided below, the pigment dispersant of the present invention can also be obtained by other synthesis methods.

Specifically, the pigment dispersant can be obtained according to the scheme provided below as an example.

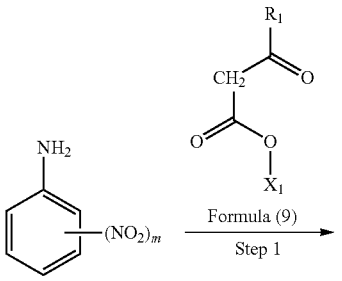

Formula (8)

-continued

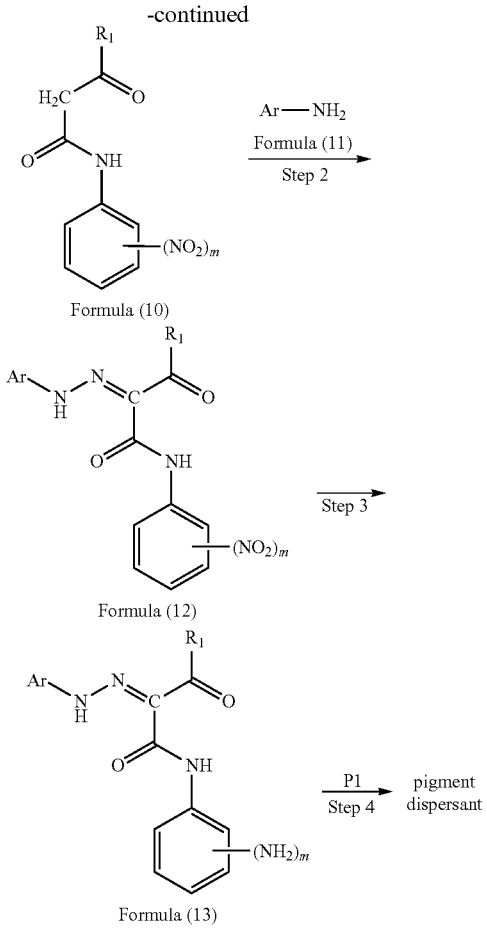

[The $R_1$ and Ar in formulas (8) to (13) have the same definitions, respectively, as the $R^1$ and Ar in formula (1). The $X_1$ in formula (9) represents a leaving group. P1 refers to the polymer moiety. The m in formula (8), formula (10), formula (12), and formula (13) indicates an integer with a value of 1 or 2.]

The azo skeleton structure-containing compound with formula (1) can be synthesized by proceeding through the following steps 1 to 4 in the scheme provided above as an example.

In step 1, the intermediate (10), which is an acylacetoanilide analog, is synthesized by the amidation of the acetoacetic acid analog with formula (9) with the nitroaniline derivative with formula (8). In step 2, the azo compound (12) is synthesized by diazo coupling between the intermediate (10) and the aniline derivative (11). In step 3, the azo compound (13) is synthesized by reduction of the nitro group in the azo compound (12). In step 4, the azo compound (13) is bonded to the polymer moiety P1 by, for example, a condensation reaction.

The methods for measuring the various properties pertinent to the present invention are described in the following.

<Method for Measuring the Hydrophobic Parameters HP1 and HP2>

The hydrophobic parameter HP1 in the present invention was measured using the following method.

50 mg (0.05 g) of the pigment dispersant is taken to an 8-mL sample vial and is dissolved in 1.48 g of chloroform and the starting mass (W1) is measured. A stir bar is introduced into the sample vial and, while stirring with a magnetic stirrer, (a) 100 mg of heptane is added dropwise and stirring is continued for 20 seconds. (b) The presence/absence of turbidity is visually scored. The process of (a) and (b) is repeated as long as turbidity is absent. The process is stopped at the point at which turbidity is observed (precipitation point) and the mass (W2) is then measured. All the measurements are carried out at 25° C. and normal pressure.

HP1 is calculated using the following formula. starting mass prior to the addition of heptane: W1 (g) mass at the turbidity point after heptane addition: W2 (g)

$$\text{hydrophobic parameter}=\{(W2-W1)/0.684\}/\{((W2-W1)/0.684)+1\}$$

The same measurement is carried out three times and the average value is taken to be HP1.

HP2 is measured in the same manner, but using the crystalline polyester in place of the pigment dispersant in the measurement method described above.

<Compositional Analysis of the Pigment Dispersant>

The structural identification of the pigment dispersant in the present invention was carried out using the following instrument: FT-NMR AVANCE-600 from Bruker (solvent used: deuterochloroform).

Compositional analysis was carried out with $^{13}$C-NMR by quantitation by the inverse-gated decoupling method using chromium(III) acetylacetonate as the relaxation reagent. The average number N of adsorption group segments in the pigment dispersant was calculated as being uniformly introduced for the composition resulting from the compositional analysis, in a molecule having as its molecular weight the number-average molecular weight Mn described below.

The number of groups with formula (4) was calculated in the same manner as for the above-described method of calculating the adsorption group segment.

<Method for Measuring the Weight-Average Particle Diameter (D4) of the Toner Particles and the Toner>

The weight-average particle diameter (D4) of the toner is determined proceeding as follows. The measurement instrument used is a "Coulter Counter Multisizer 3" (registered trademark, from Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25,000 channels for the number of effective measurement channels.

The aqueous electrolyte solution used for the measurements is prepared by dissolving special-grade sodium chloride in deionized water to provide a concentration of 1 mass % and, for example, "ISOTON II" (from Beckman Coulter, Inc.) can be used.

The dedicated software is configured as follows prior to measurement and analysis.

In the "modify the standard measurement method (SOMME)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) 30 mL of the above-described aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetra 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of this ultrasound disperser and 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the previously cited dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4). When set to graph/number % with the dedicated software, the "average diameter" on the "analysis/numerical statistical value (arithmetic average)" screen is the number-average particle diameter (D1).

<Method for Measuring the Molecular Weight>

The weight-average molecular weight (Mw) and the number-average molecular weight (Mn) of the crystalline polyester and the pigment dispersant are measured as follows using gel permeation chromatography (GPC).

The crystalline polyester or the pigment dispersant is first dissolved in tetrahydrofuran (THF) at room temperature. The obtained solution is filtered with a "Sample Pretreatment Cartridge" (Tosoh Corporation) solvent-resistant membrane filter having a pore diameter of 0.2 μm to obtain the sample solution. The sample solution is adjusted to bring the concentration of THF-soluble component to 0.8 mass %. The measurement is carried out under the following conditions using this sample solution.

instrument: "HLC-8220GPC" high-performance GPC instrument [Tosoh Corporation]
column: 2×LF-604 [Showa Denko Kabushiki Kaisha]
eluent: THF
flow rate: 0.6 mL/min
oven temperature: 40° C.
sample injection amount: 0.020 mL The determination of the molecular weight of the sample is carried out using a molecular weight calibration curve constructed using standard polystyrene resin (for example, product name "TSK Standard Polystyrene F-850, F-450, F-288, F-128, F-80, F-40, F-20, F-10, F-4, F-2, F-1, A-5000, A-2500, A-1000, A-500" from the Tosoh Corporation).

<Method for Measuring the Melting Point>

The melting point of, inter alia, the crystalline polyester is measured according to ASTM D 3418-82 using a "Q1000" (TA Instruments) differential scanning calorimeter.

Temperature correction in the instrument detection section is performed using the melting points of indium and zinc, and the amount of heat is corrected using the heat of fusion of indium.

Specifically, approximately 5 mg of the sample is exactly weighed out and this is introduced into an aluminum pan, and the measurement is run at a ramp rate of 10° C./minute in the measurement temperature range between 0° C. and 150° C. using an empty aluminum pan as reference. The measurement is carried out by initially raising the temperature to 150° C., then cooling to 0° C., and then reheating. The melting point is taken to be the peak temperature of the maximum endothermic peak in the DSC curve in the 0° C. to 150° C. temperature range in this second ramp-up process.

<Method for Measuring the Content of the Crystalline Polyester in the Toner>

The content of the crystalline polyester is determined from the integration values for the nuclear magnetic resonance ($^1$H-NMR) spectrum of the toner based on the respective nuclear magnetic resonance ($^1$H-NMR) spectra of the binder resin and crystalline polyester.
measurement instrument: JNM-EX400 FT-NMR instrument (JEOL Ltd.)
measurement frequency: 400 MHz
pulse condition: 5.0 μs
frequency range: 10500 Hz
number of integrations: 64

The crystalline polyester can be separated by various separation methods (e.g., reprecipitation, filtration), and, for example, can be separated using the following method.

<Separation of the Crystalline Polyester from the Toner>

The toner is dissolved in tetrahydrofuran (THF) and the solvent is distilled off under reduced pressure from the obtained soluble matter to obtain the tetrahydrofuran (THF)-soluble component of the toner.

The obtained tetrahydrofuran (THF)-soluble component of the toner is dissolved in chloroform to prepare a sample solution having a concentration of 25 mg/mL.

3.5 mL of the obtained sample solution is injected into the instrument indicated below and, using the conditions indicated below, is fractionated into a low-molecular weight component originating with the release agent and having a molecular weight of less than 2000 and a high-molecular weight component originating with the binder resin and having a molecular weight of at least 2000.
preparative GPC instrument: Preparative HPLC Model LC-980 from Japan Analytical Industry Co., Ltd.
preparative column: JAIGEL 3H, JAIGEL 5H (Japan Analytical Industry Co., Ltd.)
eluent: chloroform
flow rate: 3.5 mL/min After fractionation of the binder resin-originating high-molecular weight component, the solvent is distilled off under reduced pressure and drying is additionally carried out for 24 hours under reduced pressure in a 90° C. atmosphere. This procedure is repeated until about 100 mg of the binder resin component has been obtained.

100 mg of the binder resin obtained by this process is dissolved in 500 mL acetone and complete dissolution is achieved by heating to 70° C.; this is followed by gradual cooling to 25° C. to recrystallize the crystalline polyester. The crystalline polyester is subjected to suction filtration for separation into the crystalline polyester and a filtrate.

EXAMPLES

The present invention is more specifically described in the following using examples. The present invention is not limited to or by the examples that follow. Unless specifically indicated otherwise, the parts and % in the examples and comparative examples are in all cases on a mass basis.

<Production Example for Pigment Adsorption Segment Precursor (A-1)>

25.0 parts of m-nitroaniline, 15.4 parts of diketene, and 15.0 parts of acetone were first added to 140 parts of acetic acid and stirring was carried out for 3 hours at 65° C. After completion of the reaction and pouring into 1200 parts of water, filtration yielded 38.4 parts (96.0% yield) of a compound (1).

142 parts of N,N-dimethylformamide and 30.8 parts of concentrated hydrochloric acid were then added to 15.0 parts of 5-amino-2-benzimidazolinone and ice cooling to 5° C. or less was carried out. To this solution was added 7.25 parts of sodium nitrite dissolved in 50.0 parts of water and stirring was performed for 1 hour at the same temperature (diazonium salt solution). 21.9 parts of compound (1) and 68.4 parts of calcium carbonate were added to 142 parts of N,N-dimethylformamide; ice cooling to 5° C. or less was performed; the diazonium salt solution was added; and a reaction was run for 3 hours at 5° C. or less. After the completion of the reaction, the reaction solution was filtered and the solvent was distilled out under reduced pressure. The precipitated precipitate was washed with dilute hydrochloric acid, water, and methanol to obtain 36.0 parts (94.3% yield) of a compound (2).

The obtained compound (2) was added to 203 parts of 1,4-dioxane and a solution of 12.4 parts of sodium hydrosulfide dissolved in 80 parts of water was added dropwise at room temperature. After the completion of the dropwise addition, the solution was heated and stirring was performed for 26 hours at 50° C. After the completion of the reaction, the reaction solution was poured into water and the precipitated precipitate was filtered off and washed with dilute hydrochloric acid, water, and methanol to obtain 10.0 parts (50.6% yield) of a pigment adsorption segment precursor (A-1) (compound (3)). The structure of pigment adsorption segment precursor (A-1) is given in Table 1. The $R^1$ to $R^6$ and Ar in the table indicate the substituents in formula (1), and the $R^{11}$ to $R^{15}$ for the Ar correspond to the $R^{11}$ to $R^{15}$ in formula (3). The Ar is phenyl.

<Production Example for Pigment Adsorption Segment Precursors (A-2) and (A-3)>

Pigment adsorption segment precursors (A-2) and (A-3) were obtained proceeding as for pigment adsorption segment precursor 1 in the Production Example for Pigment Adsorption Segment Precursor 1, but changing the compounds used so as to provide the composition in Table 2. The structures of pigment adsorption segment precursors (A-2) and (A-3) are given in Table 1. The $R^1$ to $R^6$ and Ar in the table indicate the substituents in formula (1), and the $R^{11}$ to $R^{15}$ for the Ar correspond to the $R^{11}$ to $R^{15}$ in formula (3). The Ar is phenyl.

TABLE 1

| pigment adsorption segment precursor | $R^1$ | $R^2$ | $R^3$ | $R^4$ | $R^5$ | $R^6$ | Ar $R^{11}$ | $R^{12}$ | $R^{13}$ | $R^{14}$ | $R^{15}$ |
|---|---|---|---|---|---|---|---|---|---|---|---|
| A-1 | —$CH_3$ | —H | —$NH_2$ | —H | —H | —H | —H | —NHCONH— | | —H | —H |
| A-2 | —$CH_3$ | —H | —$NH_2$ | —H | —H | —H | —H | —$NHCONH_2$ | —H | —H | —H |
| A-3 | —$CH_3$ | —H | —NHCONH— | | —H | —H | —H | —$NH_2$ | —H | —H | —H |

<Production Example for Polymer (P-1)>

100 parts of propylene glycol monomethyl ether was heated under nitrogen substitution and was refluxed at a liquid temperature of at least 120° C., and to this was added dropwise over 3 hours a mixture of 52 parts of styrene, 1.91 parts of methacrylic acid, 11.27 parts of stearyl methacrylate, and 1.00 parts of tert-butyl peroxybenzoate [organoperoxide-type polymerization initiator, NOF Corporation, product name: Perbutyl Z]. After the completion of the dropwise addition, the solution was stirred for 3 hours; distillation was subsequently carried out at normal pressure while raising the liquid temperature to 170° C.; and, once a liquid temperature of 170° C. had been reached, the solvent was removed by distillation for 1 hour under reduced pressure at 1 hPa to obtain a solid resin material. 65 parts of a polymer (P-1) was obtained by purification by dissolving this solid material in tetrahydrofuran and reprecipitating with n-hexane.

<Production Example for Polymers (P-2) to (P-18)>

Polymers (P-2) to (P-18) were obtained proceeding as for polymer (P-1), but changing the starting materials in the Production Example for Polymer (P-1) as shown in Table 2. The composition ratios for polymers (P-2) to (P-18) are given in Table 2.

TABLE 2

| polymer | monomer composition (mol %) styrene | stearyl acrylate | stearyl methacrylate | behenyl acrylate | butyl acrylate | acrylic acid | methacrylic acid |
|---|---|---|---|---|---|---|---|
| P-1 | 90 | 0 | 6.0 | 0 | 0 | 0 | 4 |
| P-2 | 90 | 0 | 5.0 | 0 | 0 | 0 | 5 |
| P-3 | 97 | 0 | 0.0 | 0 | 0 | 3 | 0 |
| P-4 | 87 | 0 | 10.0 | 0 | 0 | 3 | 0 |
| P-5 | 94 | 0 | 2.0 | 0 | 0 | 4 | 0 |
| P-6 | 85 | 0 | 10.0 | 0 | 0 | 4 | 0 |
| P-7 | 95 | 0 | 1.0 | 0 | 0 | 4 | 0 |
| P-8 | 86 | 0 | 10.5 | 0 | 0 | 3.5 | 0 |
| P-9 | 90 | 0 | 0 | 0 | 6 | 4 | 0 |
| P-10 | 90 | 0 | 0 | 6 | 0 | 4 | 0 |
| P-11 | 93 | 6 | 0 | 0 | 0 | 0 | 1 |
| P-12 | 88 | 0 | 6 | 0 | 0 | 6 | 0 |
| P-13 | 93.5 | 6 | 0 | 0 | 0 | 0 | 0.5 |
| P-14 | 86 | 0 | 6.5 | 0 | 0 | 7.5 | 0 |
| P-15 | 88 | 0 | 8 | 0 | 0 | 0 | 4 |
| P-16 | 91 | 6 | 0 | 0 | 0 | 0 | 3 |
| P-17 | 96 | 0 | 0 | 0 | 0 | 0 | 4 |
| P-18 | 82.5 | 13 | 0 | 0 | 0 | 4.5 | 0 |

<Production Example for Polymer (P-19)>

A polyester resin (a) was obtained by introducing
terephthalic acid: 21.0 parts,
isophthalic acid: 21.0 parts,
bisphenol A-2 mol propylene oxide adduct: 120 parts, and
dibutyltin oxide: 0.030 parts
into an autoclave equipped with a pressure reduction apparatus, a water separation apparatus, a nitrogen gas introduction apparatus, a temperature measurement apparatus, and a stirring apparatus; reacting for 15 hours at 220° C. under a nitrogen atmosphere and normal pressure; and additionally reacting for 2.5 hours under a reduced pressure of 10 to 20 mmHg. The Mw of the obtained polyester resin (a) was 12,000.

100 parts of the obtained polyester resin (a) was added to 440.0 parts of dry chloroform; after complete dissolution had been achieved, 4 parts of 2-isocyanatoethyl methacrylate [Showa Denko Kabushiki Kaisha, product name: "Karenz MOI"] was added while carrying out ice cooling; and stirring was subsequently carried out overnight at room temperature (25° C.).

The resulting resin solution was gradually dripped into a vessel filled with 550.0 parts methanol in order to reprecipitate the resin fraction, and this was followed by filtration, purification, and drying to obtain a polyester resin (b).

Then, 100.0 parts of the polyester resin (b) obtained as described above, 10.0 parts of styrene, 6.0 parts of stearyl acrylate, 5.0 parts of acrylic acid, and 10.0 parts of Perbutyl D [NOF Corporation] were added to a reactor equipped with a stirrer, thermometer, and nitrogen introduction tube, and a polymerization reaction was run at a temperature of 110° C. while stirring to obtain a polymer (P-19).

<Production Example for Pigment Dispersant (S-1)>

10.0 parts of polymer (P-1) was dissolved in 100 parts of chloroform; 2.06 parts of thionyl chloride was added dropwise; and stirring was performed for 24 hours at room temperature. After this, the chloroform and excess thionyl chloride were removed by concentrating the reaction solution; the resulting solid resin material was recovered and redissolved in 61.1 parts of N,N-dimethylacetamide; and 1.71 parts of pigment adsorption segment precursor (A-1)

was added and stirring was carried out for 3 hours at 65° C. under a nitrogen atmosphere. After the completion of the reaction, the reaction solution was concentrated followed by reprecipitation with methanol to obtain 9.87 parts of pigment dispersant (S-1).

The results of the molecular weight measurement on the obtained pigment dispersant (S-1) were a number-average molecular weight of 11,500 and a weight-average molecular weight of 29,000, and the results of the $^{13}$C-NMR measurement were, per molecule, 3.9 for the average number of adsorption group segments and 5.9 for the number of groups with structural formula (4) (alkoxycarbonyl group).

The composition of pigment dispersant (S-1) is shown in Table 3. In the case of pigment dispersant (S-1), $R^3$ in formula (3) is a carboxamide bond (—CONH—) functioning as a linking group and is bonded to the polymer moiety.

<Production Example for Pigment Dispersants (S-2) to (S-21)>

Pigment dispersants (S-2) to (S-21) were obtained proceeding as for pigment dispersant (S-1) in the Production Example for Pigment Dispersant (S-1), but changing to the compositions in Table 3. The compositions of pigment dispersants (S-2) to (S-21) are given in Table 3. In the case of pigment dispersants (S-2) to (S-18) and (S-21), $R^3$ in formula (3) represents a carboxamide bond (—CONH—) functioning as a linking group and is bonded to the polymer moiety. In the case of pigment dispersant (S-19), $R^3$ in formula (3) represents a carboxamide bond (—CONH—) functioning as a linking group and is bonded to the polymer moiety. In the case of (S-20), $R^{12}$ in formula (3) represents a carboxamide bond (—CONH—) functioning as a linking group and is bonded to the polymer moiety.

TABLE 3

| pigment dispersant | pigment adsorption segment | polymer moiety | number of alkoxy-carbonyl groups | number of adsorption segments | molecular weight Mn | molecular weight Mw |
|---|---|---|---|---|---|---|
| S-1 | A-1 | P-1 | 5.9 | 3.9 | 11500 | 29000 |
| S-2 | A-1 | P-2 | 4.0 | 4.0 | 9300 | 29000 |
| S-3 | A-1 | P-3 | 0.0 | 2.9 | 10000 | 29000 |
| S-4 | A-1 | P-4 | 10.3 | 3.1 | 13000 | 32000 |
| S-5 | A-1 | P-5 | 2.0 | 4.1 | 11000 | 29000 |
| S-6 | A-1 | P-6 | 10.0 | 4.0 | 12500 | 34000 |
| S-7 | A-1 | P-7 | 1.0 | 3.8 | 10000 | 29000 |
| S-8 | A-1 | P-8 | 11.9 | 4.0 | 14500 | 43000 |
| S-9 | A-1 | P-9 | 5.9 | 3.9 | 9500 | 25000 |
| S-10 | A-1 | P-10 | 6.0 | 4.0 | 12000 | 31000 |
| S-11 | A-1 | P-11 | 6.1 | 1.0 | 12000 | 30000 |
| S-12 | A-1 | P-12 | 5.9 | 5.9 | 11500 | 32000 |
| S-13 | A-1 | P-13 | 6.1 | 0.5 | 12000 | 30000 |
| S-14 | A-1 | P-14 | 6.1 | 7.1 | 11000 | 31000 |
| S-15 | A-1 | P-15 | 8.2 | 4.1 | 12500 | 33000 |
| S-16 | A-1 | P-16 | 5.9 | 3.0 | 11500 | 30000 |
| S-17 | A-1 | P-17 | 0.0 | 3.9 | 10000 | 30000 |
| S-18 | A-1 | P-18 | 11.9 | 4.1 | 12000 | 31000 |
| S-19 | A-2 | P-1 | 6.0 | 3.9 | 11500 | 29000 |
| S-20 | A-3 | P-1 | 5.9 | 4.1 | 11500 | 29000 |
| S-21 | A-1 | P-19 | 6.0 | 4.2 | 11500 | 29000 |

<Production of Crystalline Polyester 1>

While carrying out nitrogen replacement, 100 parts of xylene was heated in a reactor equipped with a stirrer, thermometer, nitrogen introduction tube, and pressure reduction apparatus and was refluxed at a liquid temperature of 140° C. To this solution was added dropwise a mixture of 100.0 parts of styrene and 6.0 parts of dimethyl 2,2'-azobis (2-methylpropionate) over 3 hours and the solution was stirred for 3 hours after the completion of the dropwise addition. This was followed by distillative removal of the xylene and remaining styrene at 1 hPa and 160° C. to obtain a vinyl polymer (1).

0.43 parts of titanium(IV) isopropoxide was added as an esterification catalyst to 100.0 parts of the vinyl polymer (1) obtained as described above, 88.0 parts of xylene as an organic solvent, and 120.0 parts of 1,12-dodecanediol in a reactor equipped with a stirrer, thermometer, nitrogen introduction tube, water separation tube, and pressure reduction apparatus, and a reaction was then run for 4 hours at 150° C. under a nitrogen atmosphere. This was followed by the addition of 124.0 parts of 1,10-decanedicarboxylic acid and reaction for 3 hours at 150° C. and 4 hours at 180° C. After this, the reaction was carried out at 180° C. and 1 hPa until the desired weight-average molecular weight (Mw) had been reached to obtain a crystalline polyester 1. The obtained crystalline polyester had a distinct endothermic peak in the DSC measurement, and the temperature of this peak (melting point) was 78° C. The properties of the obtained crystalline polyester 1 are given in Table 4.

<Production of Crystalline Polyesters 2 to 4, 7, 10 to 13, and 15>

Crystalline polyesters were obtained proceeding as in Production of Crystalline Polyester 1, but changing the starting materials as shown in Table 4. The properties of the obtained crystalline polyesters are shown in Table 4. The obtained crystalline polyesters each had a distinct endothermic peak in the DSC measurement.

TABLE 4

| crystalline polyester No. | polyester segment m | polyester segment n | polyester segment acid monomer | mass parts | alcohol monomer | mass parts | polystyrene segment styrene | mass parts | molecular weight Mw |
|---|---|---|---|---|---|---|---|---|---|
| 1 | 10 | 12 | 1,10-decanedicarboxylic acid | 124 | 1,12-dodecanediol | 120 | styrene | 100 | 25000 |
| 2 | 8 | 12 | sebacic acid | 117 | 1,12-dodecanediol | 128 | styrene | 100 | 27000 |
| 3 | 8 | 9 | sebacic acid | 130 | 1,9-nonanediol | 113 | styrene | 100 | 30000 |
| 4 | 6 | 10 | suberic acid | 117 | 1,10-decanediol | 128 | styrene | 100 | 29000 |
| 7 | 5 | 5 | pimelic acid | 141 | 1,5-pentanediol | 101 | styrene | 100 | 28000 |
| 10 | 4 | 4 | adipic acid | 144 | 1,4-butanediol | 98 | styrene | 100 | 25500 |
| 11 | 12 | 12 | 1,12-dodecanedicarboxylic acid | 131 | 1,12-dodecanediol | 113 | styrene | 100 | 26000 |
| 12 | 8 | 2 | sebacic acid | 179 | ethylene glycol | 60 | styrene | 100 | 26500 |

TABLE 4-continued

| crystalline polyester No. | polyester segment m | n | acid monomer | mass parts | alcohol monomer | mass parts | polystyrene segment styrene | mass parts | molecular weight Mw |
|---|---|---|---|---|---|---|---|---|---|
| 13 | 14 | 12 | 1,14-tetradecanedicarboxylic acid | 137 | 1,12-dodecanediol | 106 | styrene | 100 | 27000 |
| 15 | 8 | 6 | sebacic acid | 147 | 1,6-hexanediol | 95 | styrene | 100 | 22000 |

The m and n in the table denote the m and n in formulas (6) and (7).

<Production of Crystalline Polyester 5>

100.0 parts of 1,10-decanedicarboxylic acid and 120.0 parts of 1,12-dodecanediol were added to a reactor equipped with a stirrer, thermometer, nitrogen introduction tube, water separation tube, and pressure reduction apparatus and were heated to a temperature of 130° C. while stirring. 0.7 parts of titanium(IV) isopropoxide was added as the esterification catalyst and the temperature was then raised to 160° C. and a condensation polymerization was run for 5 hours. After this the temperature was raised to 180° C. and, while reducing the pressure, the reaction was run until the desired molecular weight was reached to obtain crystalline polyester 5. The properties of the obtained crystalline polyester 5 are given in Table 5. The obtained crystalline polyester had a distinct endothermic peak in the DSC measurement.

<Production of Crystalline Polyesters 6, 8, and 9>

These crystalline polyesters were obtained proceeding as in Production of Crystalline Polyester 5, but changing the starting materials as shown in Table 5. The obtained crystalline polyesters each had a distinct endothermic peak in the DSC measurement.

TABLE 5

| crystalline polyester No. | polyester segment m | n | acid monomer | mass parts | alcohol monomer | mass parts | molecular weight Mw |
|---|---|---|---|---|---|---|---|
| 5 | 10 | 12 | 1,10-decanedicarboxylic acid | 100 | 1,12-dodecanediol | 120 | 21000 |
| 6 | 8 | 12 | sebacic acid | 100 | 1,12-dodecanediol | 128 | 22000 |
| 8 | 10 | 10 | 1,10-decanedicarboxylic acid | 100 | 1,10-decanediol | 113 | 25000 |
| 9 | 8 | 9 | sebacic acid | 100 | 1,9-nonanediol | 128 | 19000 |

The m and n in the table denote the m and n in formulas (6) and (7).

<Production of Crystalline Polyester 16>

100.0 parts of 1,10-decanedicarboxylic acid and 93.5 parts of 1,12-dodecanediol were added to a reactor equipped with a stirrer, thermometer, nitrogen introduction tube, water separation tube, and pressure reduction apparatus and were heated to a temperature of 130° C. while stirring. After the addition of 0.7 parts of titanium(IV) isopropoxide, the temperature was raised to 160° C. and a condensation polymerization was run for 5 hours. 15.0 parts of acrylic acid and 140.0 parts of styrene were added dropwise over 1 hour. Stirring was continued for 1 hour while holding at 160° C., after which the monomer for the styrene resin component was removed for 1 hour at 8.3 kPa. After this, the temperature was raised to 210° C. and the reaction was run until the desired molecular weight was reached to obtain a crystalline polyester 16. The Mw of the obtained crystalline polyester was 23,000. The obtained crystalline polyester had a distinct endothermic peak in the DSC measurement.

<Production Example for Black Toner Particle 1>

[Step of Producing Colorant Dispersion 1]

| | |
|---|---|
| styrene monomer | 100.0 parts |
| carbon black (CB) | 20.0 parts |
| Nipex 35 (Orion Engineered Carbons) | |
| pigment dispersant (S-1) | 2.0 parts |

These materials were introduced into an attritor (Mitsui Mining Co., Ltd.) and were stirred at 200 rpm and 25° C. for 180 minutes using zirconia beads (200 parts) having a radius of 2.5 mm to produce a colorant dispersion 1.

[Step of Producing a Toner Composition Solution]

| | |
|---|---|
| colorant dispersion 1 | 48.8 parts |
| styrene | 27.5 parts |
| n-butyl acrylate | 22.5 parts |
| crystalline polyester 1 | 5.0 parts |
| hydrocarbon wax | 10.0 parts |
| (Fischer-Tropsch wax, peak temperature of maximum endothermic peak = 78° C., Mw = 750) | |

-continued

| | |
|---|---|
| polar resin 1 | 5.0 parts |
| (styrene-methacrylic acid-methyl methacrylate-2-hydroxyethyl methacrylate copolymer, Mw = 14,800, Tg = 89° C., acid value Av = 22 mg KOH/g, hydroxyl value OHv = 8 mg KOH/g) | |
| salicylic acid compound | 1.0 parts |
| (BONTRON E84 (Orient Chemical Industries Co., Ltd.)) | |

These materials were mixed and heated to 65° C. and were dissolved and dispersed to uniformity for 60 minutes at 5,000 rpm using a TK Homomixer (Tokushu Kika Kogyo Co., Ltd.) to obtain a toner composition solution 1.

[Step of Producing a Dispersion of Black Toner Particle 1]

450 parts of a 0.1 M aqueous $Na_3PO_4$ solution was introduced into 710 parts of deionized water in a 2-L four-neck flask equipped with a TK Homomixer high-speed stirrer and heating to 60° C. was carried out. This was followed by the gradual addition of 67.7 parts of a 1.0 M aqueous $CaCl_2$ solution to obtain a calcium phosphate compound-containing aqueous medium.

8 parts of a 70% toluene solution of the polymerization initiator 1,1,3,3-tetramethylbutyl peroxy-2-ethylhexanoate was then dissolved in the toner composition solution followed after thorough stirring by introduction into the aforementioned aqueous medium. This was stirred at a temperature of 62° C. under an $N_2$ atmosphere for 10 minutes at 12,000 rpm using a TK Homomixer to granulate the polymerizable monomer composition. The temperature was then raised to 75° C. while stirring with a paddle stirring blade and polymerization was carried out for 7.5 hours and the polymerization reaction was completed. The residual solvent was subsequently distilled out under reduced pressure and the aqueous medium was cooled to obtain a dispersion of a toner particle 1. The weight-average particle diameter (D4) of the obtained toner particle (the toner particle prior to the addition of external additive) was 5.9 μm.

Hydrochloric acid was added to the dispersion of black toner particle 1 to bring the pH to 1.4 and the calcium phosphate salt was dissolved by stirring for 1 hour. This was subjected to solid-liquid separation using a pressure filter under a pressure of 0.4 MPa to obtain a toner cake. Deionized water was then added to the pressure filter until it was filled and washing was carried out at a pressure of 0.4 MPa. This washing process was carried out three times followed by drying to obtain a black toner particle 1. Black toner particle 1 is shown in Table 6.

<Production Example for Black Toner Particles 2 to 25>

Black toner particles 2 to 25 were obtained proceeding as in the Production Example for Black Toner Particle 1, but changing the composition of black toner particle 1 as shown in the Table 6. Black toner particles 2 to 25 are shown in Table 6.

<Production Example for Black Toner Particle 26>

[Step of Producing a Colorant Dispersion 2]

| | |
|---|---|
| toluene | 350.0 parts |
| carbon black (CB) | 56.0 parts |
| Nipex 35 (Orion Engineered Carbons) | |
| pigment dispersant (S-18) | 5.6 parts |
| salicylic acid compound | 10.0 parts |
| (BONTRON E84 (Orient Chemical Industries Co., Ltd.)) | |

These materials were introduced into an attritor (Mitsui Mining Co., Ltd.) and were stirred at 200 rpm and 25° C. for 180 minutes using zirconia beads (200 parts) having a radius of 2.5 mm to produce a colorant dispersion 2.

[Step of Producing a Toner Composition Solution 2]

| | |
|---|---|
| colorant dispersion 2 | 250.0 parts |
| polar resin | 25.0 parts |
| (copolymer of styrene, methacrylic acid, methyl methacrylate, and 2-hydroxyethyl methacrylate, Mw = 14,800, Tg = 89° C., acid value Av = 22 mg KOH/g, hydroxyl value OHv = 8 mg KOH/g) | |
| styrene-acrylic resin | 450.0 parts |
| (copolymer of styrene:n-butyl acrylate = 75:25 (mass ratio)) (Mw = 30,000, Tg = 55° C.) | |
| crystalline polyester 15 | 25.0 parts |
| hydrocarbon wax | 35.0 parts |
| (Fischer-Tropsch wax; HNP-9) | |

These materials were mixed and heated to 65° C. and were dissolved and dispersed to uniformity for 60 minutes at 5,000 rpm using a TK Homomixer (Tokushu Kika Kogyo Co., Ltd.) to obtain a toner composition solution 2.

[Step of Producing a Toner Particle Dispersion 2]

300 parts of a 0.5 M aqueous $Na_3PO_4$ solution was introduced into 1200 parts of deionized water in a 2-L four-neck flask equipped with a TK Homomixer high-speed stirrer. After this the TK Homomixer was adjusted to 12,000 rpm and heating to 60° C. was carried out. This was followed by the gradual addition of 25.7 parts of a 1.0 M aqueous $CaCl_2$ solution to obtain a calcium phosphate compound-containing aqueous medium.

The toner composition solution 2 was then introduced into this aqueous medium. This was stirred at a temperature of 65° C. under an $N_2$ atmosphere for 30 minutes at 12,000 rpm using a TK Homomixer to granulate the toner composition solution 2 into particles. The residual solvent was subsequently distilled out under reduced pressure and the aqueous medium was cooled to obtain a toner particle dispersion 2. The weight-average particle diameter (D4) of the obtained toner particles was 5.9 μm.

Hydrochloric acid was added to the toner particle dispersion to bring the pH to 1.4 and the calcium phosphate salt was dissolved by stirring for 1 hour. This was subjected to solid-liquid separation using a pressure filter under a pressure of 0.4 MPa to obtain a toner cake. Deionized water was then added to the pressure filter until it was filled and washing was carried out at a pressure of 0.4 MPa. This washing process was carried out three times followed by drying to obtain a black toner particle 26.

The toner particle composition of black toner particle 26 is shown in Table 6.

TABLE 6

| black toner | | resin component | | | | | | | | particle diameter | |
|---|---|---|---|---|---|---|---|---|---|---|---|
| | | binder resin | | crystalline polyester | | pigment | | pigment dispersant | | | |
| particle No. | production method | type | composition ratio* | type (No.) | composition ratio | type | composition ratio | type | composition ratio | D4 (μm) | (HP1 − HP2) |
| 1 | suspension polymerization | St/BA/polar resin | 67.5/22.5/5.0 | 1 | 5.0 | C B | 8.0 | S-1 | 0.80 | 5.9 | −0.06 |
| 2 | suspension polymerization | St/BA/polar resin | 67.5/22.5/5.0 | 1 | 5.0 | C B | 8.0 | S-3 | 0.80 | 6.0 | −0.26 |
| 3 | suspension polymerization | St/BA/polar resin | 67.5/22.5/5.0 | 7 | 5.0 | C B | 8.0 | S-4 | 0.80 | 5.9 | 0.14 |
| 4 | suspension polymerization | St/BA/polar resin | 67.5/22.5/5.0 | 2 | 5.0 | C B | 8.0 | S-5 | 0.80 | 6.2 | −0.17 |
| 5 | suspension polymerization | St/BA/polar resin | 67.5/22.5/5.0 | 2 | 5.0 | C B | 8.0 | S-6 | 0.80 | 6.1 | 0.05 |
| 6 | suspension polymerization | St/BA/polar resin | 67.5/22.5/5.0 | 2 | 5.0 | C B | 8.0 | S-7 | 0.80 | 5.7 | −0.21 |

TABLE 6-continued

| black toner particle No. | production method | resin component: binder resin type | binder resin composition ratio* | crystalline polyester type (No.) | crystalline polyester composition ratio | pigment type | pigment composition ratio | pigment dispersant type | pigment dispersant composition ratio | particle diameter D4 (μm) | (HP1 − HP2) |
|---|---|---|---|---|---|---|---|---|---|---|---|
| 7 | suspension polymerization | St/BA/polar resin | 67.5/22.5/5.0 | 2 | 5.0 | C B | 8.0 | S-8 | 0.80 | 6.3 | 0.13 |
| 8 | suspension polymerization | St/BA/polar resin | 67.5/22.5/5.0 | 2 | 5.0 | C B | 8.0 | S-9 | 0.80 | 6.0 | −0.04 |
| 9 | suspension polymerization | St/BA/polar resin | 67.5/22.5/5.0 | 6 | 5.0 | C B | 8.0 | S-10 | 0.80 | 6.1 | −0.04 |
| 10 | suspension polymerization | St/BA/polar resin | 67.5/22.5/5.0 | 9 | 5.0 | C B | 8.0 | S-11 | 0.80 | 6.2 | −0.02 |
| 11 | suspension polymerization | St/BA/polar resin | 67.5/22.5/5.0 | 9 | 5.0 | C B | 8.0 | S-12 | 0.80 | 6.0 | −0.02 |
| 12 | suspension polymerization | St/BA/polar resin | 67.5/22.5/5.0 | 9 | 5.0 | C B | 8.0 | S-13 | 0.80 | 6.0 | −0.02 |
| 13 | suspension polymerization | St/BA/polar resin | 67.5/22.5/5.0 | 9 | 5.0 | C B | 8.0 | S-14 | 0.80 | 6.1 | −0.02 |
| 14 | suspension polymerization | St/BA/polar resin | 67.5/22.5/5.0 | 3 | 5.0 | C B | 8.0 | S-1 | 0.80 | 6.3 | −0.02 |
| 15 | suspension polymerization | St/BA/polar resin | 67.5/22.5/5.0 | 10 | 5.0 | C B | 8.0 | S-15 | 0.80 | 6.1 | 0.05 |
| 16 | suspension polymerization | St/BA/polar resin | 67.5/22.5/5.0 | 11 | 5.0 | C B | 8.0 | S-15 | 0.80 | 6.2 | −0.08 |
| 17 | suspension polymerization | St/BA/polar resin | 67.5/22.5/5.0 | 12 | 5.0 | C B | 8.0 | S-15 | 0.80 | 6.3 | −0.09 |
| 18 | suspension polymerization | St/BA/polar resin | 67.5/22.5/5.0 | 13 | 5.0 | C B | 8.0 | S-15 | 0.80 | 6.3 | 0.04 |
| 19 | suspension polymerization | St/BA/polar resin | 67.5/22.5/5.0 | 5 | 5.0 | C B | 8.0 | S-16 | 0.16 | 6.0 | −0.06 |
| 20 | suspension polymerization | St/BA/polar resin | 67.5/22.5/5.0 | 5 | 5.0 | C B | 8.0 | S-16 | 1.60 | 6.1 | −0.06 |
| 21 | suspension polymerization | St/BA/polar resin | 67.5/22.5/5.0 | 5 | 5.0 | C B | 8.0 | S-16 | 0.04 | 6.2 | −0.06 |
| 22 | suspension polymerization | St/BA/polar resin | 67.5/22.5/5.0 | 5 | 5.0 | C B | 8.0 | S-16 | 2.00 | 6.1 | −0.06 |
| 23 | suspension polymerization | St/BA/polar resin | 67.5/22.5/5.0 | 1 | 5.0 | C B | 8.0 | — | 0.00 | 6.1 | — |
| 24 | suspension polymerization | St/BA/polar resin | 67.5/22.5/5.0 | — | — | C B | 8.0 | S-1 | 0.80 | 6.3 | — |
| 25 | suspension polymerization | St/BA/polar resin | 67.5/22.5/5.0 | 13 | 5.0 | C B | 8.0 | S-17 | 0.80 | 6.0 | −0.30 |
| 26 | dissolution suspension | styrene-acrylic resin 1/polar resin | 90/5.0 | 15 | 50 | C B | 8.0 | S-18 | 0.80 | 5.9 | 0.18 |

*In the tables, the composition ratio for the individual materials indicates the mass ratio in the toner composition.

<Production Example for Magenta Toner Particle 1>

[Step of Producing Colorant Dispersion 3]

| | |
|---|---|
| styrene monomer | 100.0 parts |
| Pigment Red 122 (PR-122) (Toner Magenta E [Clariant]) | 16.7 parts |
| pigment dispersant (S-1) | 1.67 parts |

These materials were introduced into an attritor (Mitsui Mining Co., Ltd.) and were stirred at 200 rpm and 25° C. for 180 minutes using zirconia beads (200 parts) having a radius of 2.5 mm to produce a colorant dispersion 3.

[Step of Producing Toner Composition Solution 3]

| | |
|---|---|
| colorant dispersion 3 | 63.9 parts |
| styrene | 13.5 parts |
| n-butyl acrylate | 22.5 parts |
| crystalline polyester 2 | 5.0 parts |
| hydrocarbon wax (Fischer-Tropsch wax, peak temperature of maximum endothermic peak = 78° C., Mw = 750) | 10.0 parts |

-continued

| | |
|---|---|
| polar resin 1 (styrene-methacrylic acid-methyl methacrylate-2-hydroxyethyl methacrylate copolymer, Mw = 14,800, Tg = 89° C., acid value Av = 22 mg KOH/g, hydroxyl value OHv = 8 mg KOH/g) | 5.0 parts |
| salicylic acid compound (BONTRON E84 (Orient Chemical Industries Co., Ltd.)) | 1.0 parts |

These materials were mixed and heated to 65° C. and were dissolved and dispersed to uniformity for 60 minutes at 5,000 rpm using a TK Homomixer (Tokushu Kika Kogyo Co., Ltd.) to obtain a toner composition solution 3.

A magenta toner particle 1 was obtained proceeding from this point on as for black toner particle 1. The weight-average particle diameter (D4) of the obtained magenta toner particle 1 was 6.2 μm. The obtained magenta toner particle 1 is shown in Table 7.

<Production Example for Magenta Toner Particle 2>

A magenta toner particle 2 was obtained proceeding as in the Production Example for Magenta Toner Particle 1, but changing the pigment from Pigment Red 122 (PR-122) to Pigment Red 150 (PR-150) [Fuji Fast Carmine 522: Fuji Pigment Co., Ltd.] and changing pigment dispersant (S-1) to pigment dispersant (S-2). The obtained magenta toner particle 2 is shown in Table 7.

<Production Example for Magenta Toner Particles 3 to 5, 7, and 8>

Magenta toner particles 3 to 5, 7, and 8 were obtained proceeding as in the Production Example for Magenta Toner Particle 1, but changing the composition of magenta toner particle 1 as shown in the table. The obtained magenta toner particles 3 to 5, 7, and 8 are shown in Table 7.

<Production Example for Magenta Toner Particle 6>

| | |
|---|---|
| styrene-acrylic resin (copolymer of styrene:n-butyl acrylate = 75:25 (mass ratio)) (Mw = 30,000, Tg = 55° C.) | 90.0 parts |
| crystalline polyester 3 | 5.0 parts |
| polar resin 1 (styrene-methacrylic acid-methyl methacrylate-2-hydroxyethyl methacrylate copolymer, Mw = 14,800, Tg = 89° C., acid value Av = 22 mg KOH/g, hydroxyl value OHv = 8 mg KOH/g) | 5.0 parts |
| Pigment Red 122 (PR-122) (Toner Magenta E [Clariant]) | 9.0 parts |
| salicylic acid compound (BONTRON E84 (Orient Chemical Industries Co., Ltd.)) | 1.0 parts |
| hydrocarbon wax (Fischer-Tropsch wax; HNP-9) | 5.0 parts |
| pigment dispersant (S-1) | 0.9 parts |

The materials in this formulation were thoroughly mixed with a Henschel mixer and were then kneaded using a twin-screw kneader set to a temperature of 130° C. The obtained kneaded material was cooled and coarsely pulverized to 2 mm and below using a hammer mill to obtain a coarsely pulverized material.

The obtained coarsely pulverized material was subjected to an intermediate pulverization to a weight-average particle diameter of 100 μm using an ACM10 from Hosokawa Micron Corporation, and the obtained intermediate pulverized material was finely pulverized using a mechanical pulverizer (Turbomill Model T250-RS from Turbo Kogyo Co., Ltd.). The obtained finely pulverized material was then submitted to coarse particle classification using a Turboplex 100ATP from Hosokawa Micron Corporation to obtain magenta toner particle 6. Magenta toner particle 6 is shown in Table 7.

<Production Example for Yellow Toner Particle 1>

[Step of Producing Colorant Dispersion 4]

| | |
|---|---|
| styrene monomer | 100.0 parts |
| Pigment Yellow 155 (PY-155) (Paliotol Yellow D1155 [BASF]) | 16.7 parts |
| pigment dispersant (S-2) | 1.67 parts |

These materials were introduced into an attritor (Mitsui Mining Co., Ltd.) and were stirred at 200 rpm and 25° C. for 180 minutes using zirconia beads (200 parts) having a radius of 2.5 mm to produce a colorant dispersion 4.

[Step of Producing Toner Composition Solution 4]

| | |
|---|---|
| colorant dispersion 4 | 63.9 parts |
| styrene | 13.5 parts |
| n-butyl acrylate | 22.5 parts |
| crystalline polyester 4 | 5.0 parts |
| hydrocarbon wax (Fischer-Tropsch wax, peak temperature of maximum endothermic peak = 78° C., Mw = 750) | 10.0 parts |
| polar resin 1 (styrene-methacrylic acid-methyl methacrylate-2-hydroxyethyl methacrylate copolymer, Mw = 14,800, Tg = 89° C., acid value Av = 22 mg KOH/g, hydroxyl value OHv = 8 mg KOH/g) | 5.0 parts |
| salicylic acid compound (BONTRON E84 (Orient Chemical Industries Co., Ltd.)) | 1.0 parts |

These materials were mixed and heated to 65° C. and were dissolved and dispersed to uniformity for 60 minutes at 5,000 rpm using a TK Homomixer (Tokushu Kika Kogyo Co., Ltd.) to obtain a toner composition solution 4. A yellow toner particle 1 was obtained proceeding from this point on as for black toner particle 1. The weight-average particle diameter (D4) of the obtained toner particle was 6.2 μm. The obtained yellow toner particle 1 is shown in Table 8.

<Production Example for Yellow Toner Particle 2>

A yellow toner particle 2 was obtained proceeding as in the Production Example for Yellow Toner Particle 1, but changing the pigment from Pigment Yellow 155 to Pigment Yellow 185 (PY-185) (Toner Yellow 4G [Clariant]). The obtained yellow toner particle 2 is shown in Table 8.

TABLE 7

| magenta toner | | resin component | | | | | | | | particle diameter | |
|---|---|---|---|---|---|---|---|---|---|---|---|
| | | binder resin | | crystalline polyester | | colorant | | pigment dispersant | | | |
| particle No. | production method | type | composition ratio* | type (No.) | composition ratio | type | composition ratio | type | composition ratio | D4 (μm) | (HP1 − HP2) |
| 1 | suspension polymerization | St/BA/polar resin | 67.5/22.5/5.0 | 2 | 5.0 | PR-122 | 9.0 | S-1 | 0.90 | 6.2 | −0.04 |
| 2 | suspension polymerization | St/BA/polar resin | 67.5/22.5/5.0 | 3 | 5.0 | PR-150 | 9.0 | S-2 | 0.90 | 6.1 | −0.08 |
| 3 | suspension polymerization | St/BA/polar resin | 67.5/22.5/5.0 | 8 | 5.0 | PR-122 | 9.0 | S-19 | 0.90 | 6.3 | −0.04 |
| 4 | suspension polymerization | St/BA/polar resin | 67.5/22.5/5.0 | 8 | 5.0 | PR-122 | 9.0 | S-20 | 0.90 | 6.0 | −0.04 |
| 5 | dissolution suspension | St/BA/polar resin | 67.5/22.5/5.0 | 9 | 5.0 | PR-150 | 9.0 | S-1 | 0.90 | 6.2 | −0.02 |
| 6 | pulverization | styrene-acrylic resin 1/polar resin | 90.0/5.0 | 3 | 5.0 | PR-150 | 9.0 | S-1 | 0.90 | 6.4 | −0.02 |
| 7 | suspension polymerization | St/BA/polar resin | 67.5/22.5/5.0 | 5 | 5.0 | PR-122 | 9.0 | S-1 | 0.90 | 5.9 | −0.06 |
| 8 | suspension polymerization | St/BA/polar resin | 67.5/22.5/5.0 | 14 | 5.0 | PR-122 | 9.0 | S-1 | 0.90 | 6.1 | −0.06 |

<Production Example for Yellow Toner Particle 3>

A yellow toner particle 3 was obtained proceeding as in the Production Example for Yellow Toner Particle 1, but changing the pigment from Pigment Yellow 155 to Pigment Yellow 180 (PY-180) [Novoperm Yellow P-HG (Clariant)]. Yellow toner particle 3 is shown in Table 8.

<Production Example for Yellow Toner Particles 4 to 6>

Yellow toner particles 4 to 6 were obtained proceeding as in the Production Example for Yellow Toner Particle 1, but changing the composition of yellow toner particle 1 as shown in the table. Yellow toner particles 4 to 6 are shown in Table 8.

TABLE 8

| yellow toner | | resin component | | | | | | | | particle diameter | |
|---|---|---|---|---|---|---|---|---|---|---|---|
| | | binder resin | | crystalline polyester | | colorant | | pigment dispersant | | | |
| particle No. | production method | type | composition ratio* | type (No.) | composition ratio | type | composition ratio | type | composition ratio | D4 (μm) | (HP1 − HP2) |
| 1 | suspension polymerization | St/BA/polar resin | 67.5/22.5/5.0 | 4 | 5.0 | PY-155 | 9.0 | S-2 | 0.90 | 6.2 | −0.07 |
| 2 | suspension polymerization | St/BA/polar resin | 67.5/22.5/5.0 | 5 | 5.0 | PY-185 | 9.0 | S-2 | 0.90 | 6.3 | −0.12 |
| 3 | suspension polymerization | St/BA/polar resin | 67.5/22.5/5.0 | 6 | 5.0 | PY-180 | 9.0 | S-2 | 0.90 | 5.9 | −0.04 |
| 4 | suspension polymerization | St/BA/polar resin | 69.75/23.25/5.0 | 1 | 2.0 | PY-155 | 9.0 | S-16 | 0.90 | 5.8 | −0.06 |
| 5 | suspension polymerization | St/BA/polar resin | 56.25/18.75/5.0 | 1 | 20.0 | PY-155 | 9.0 | S-16 | 0.90 | 6.4 | −0.06 |
| 6 | suspension polymerization | St/BA/polar resin | 52.5/17.5/5.0 | 1 | 25.0 | PY-155 | 9.0 | S-16 | 0.90 | 6.5 | −0.06 |

<Production Example for Cyan Toner Particle 1>

[Step of Producing Colorant Dispersion 5]

| | |
|---|---|
| styrene monomer | 100.0 parts |
| Pigment Blue 15:3 (Pigment C1) (ECB-308 [DainichiseikaColor & Chemicals Mfg. Co., Ltd.]) | 20.0 parts |
| pigment dispersant (S-1) | 2.0 parts |

These materials were introduced into an attritor (Mitsui Mining Co., Ltd.) and were stirred at 200 rpm and 25° C. for 180 minutes using zirconia beads (200 parts) having a radius of 2.5 mm to produce the colorant dispersion.

[Step of Producing Toner Composition Solution 5]

| | |
|---|---|
| colorant dispersion 5 | 48.8 parts |
| styrene | 27.5 parts |
| n-butyl acrylate | 22.5 parts |
| crystalline polyester 3 | 5.0 parts |
| hydrocarbon wax (Fischer-Tropsch wax, peak temperature of maximum endothermic peak = 78° C., Mw = 750) | 10.0 parts |
| polar resin 1 (styrene-methacrylic acid-methyl methacrylate-2-hydroxyethyl methacrylate copolymer, Mw = 14,800, Tg = 89° C., acid value Av = 22 mg KOH/g, hydroxyl value OHv = 8 mg KOH/g) | 5.0 parts |
| salicylic acid compound (BONTRON E84 (Orient Chemical Industries Co., Ltd.)) | 1.0 parts |

These materials were mixed and heated to 65° C. and were dissolved and dispersed to uniformity for 60 minutes at 5,000 rpm using a TK Homomixer (Tokushu Kika Kogyo Co., Ltd.) to obtain a toner composition solution 5.

A cyan toner particle 1 was obtained proceeding from this point on as for black toner particle 1. The weight-average particle diameter (D4) of the obtained cyan toner particle 1 was 5.7 μm. The obtained cyan toner particle 1 is shown in Table 9.

<Production Example for Cyan Toner Particle 2>

[Step of Producing Colorant Dispersion 6]

| | |
|---|---|
| toluene | 350 parts |
| Pigment Blue 15:3 (Pigment C1) | 56.0 parts |
| pigment dispersant (S-18) | 5.6 parts |
| salicylic acid compound (BONTRON E84 (Orient Chemical Industries Co., Ltd.)) | 10.0 parts |

These materials were introduced into an attritor (Mitsui Mining Co., Ltd.) and were stirred at 200 rpm and 25° C. for 180 minutes using zirconia beads (200 parts) having a radius of 2.5 mm to produce a colorant dispersion 6.

[Step of Producing Toner Composition Solution 6]

| | |
|---|---|
| colorant dispersion 6 | 301.1 parts |
| polar resin (copolymer of styrene, methacrylic acid, methyl methacrylate, 2-hydroxyethyl methacrylate, Mw = 14,800, Tg = 89° C., acid value Av = 22 mg KOH/g, hydroxyl value OHv = 8 mg KOH/g) | 25.0 parts |
| polyester resin (a) | 450.0 parts |
| crystalline polyester 5 | 25.0 parts |
| hydrocarbon wax (Fischer-Tropsch wax; HNP-9) | 35.0 parts |

These materials were mixed and heated to 65° C. and were dissolved and dispersed to uniformity for 60 minutes at 5,000 rpm using a TK Homomixer (Tokushu Kika Kogyo Co., Ltd.) to obtain a toner composition solution 6.

A cyan toner particle 2 was obtained proceeding from this point on as for black toner particle 26.

The obtained cyan toner particle 2 is shown in Table 9.

<Production Example for Cyan Toner Particle 3>

A cyan toner particle 3 was obtained proceeding as for the Production Example for Cyan Toner Particle 1, but changing the pigment dispersant (S-1) for cyan toner particle 1 to pigment dispersant (S-21). The cyan toner particle 3 is shown in Table 9.

TABLE 9

| cyan toner particle No. | production method | resin component: binder resin type | binder resin composition ratio* | crystalline polyester type (No.) | crystalline polyester composition ratio | colorant type | colorant composition ratio | pigment dispersant type | pigment dispersant composition ratio | particle diameter D4 (μm) | (HP1 − HP2) |
|---|---|---|---|---|---|---|---|---|---|---|---|
| 1 | suspension polymerization | St/BA/polar resin | 67.5/22.5/5.0 | 3 | 5.0 | Pigment C1 | 8.0 | S-1 | 0.80 | 5.7 | −0.02 |
| 2 | dissolution suspension | polyester resin (a)/polar resin | 90/5.0 | 5 | 5.0 | Pigment C1 | 8.0 | S-16 | 0.80 | 5.8 | −0.06 |
| 3 | suspension polymerization | St/BA/polar resin | 67.5/22.5/5.0 | 5 | 5.0 | Pigment C1 | 8.0 | S-21 | 0.80 | 5.8 | −0.06 |

The tinting strength, low-temperature fixability, hot offset resistance, and transferability were evaluated according to the evaluation methods given below. The toners evaluated in these evaluations were obtained by carrying out a step in which 1.5 parts of hydrophobic silica fine powder (number-average primary particle diameter: 10 nm) that had been subjected to a surface treatment with hexamethyldisilazane, was added to 100.0 parts of the toner particle and mixing was carried out for 300 seconds with a Henschel mixer (Mitsui Mining Co., Ltd.).

<Method for Evaluating the Tinting Strength>

The toner present in a cartridge for a Satera LBP7700C (Canon, Inc.), a commercially available color laser printer, was removed therefrom; the interior was cleaned with an air blower; and the test toner (150 g) was loaded therein. In addition, a Satera LBP7700C (Canon, Inc.) was partially modified: the modification comprised detaching the fixing section and enabling the output of an unfixed image and making the image density adjustable with a controller. A modification was also made to enable operation even with only the process cartridge for one color installed.

The aforementioned cartridge was mounted in the printer and the controller was set to provide a toner laid-on amount of 0.30 mg/cm$^2$, and a rectangular 6.5 cm×14.0 cm solid image was output in the center of the transfer material to provide the evaluation image. Letter-size HP LASER JET PAPER (Hewlett-Packard, 90.0 g/m$^2$) was used as the transfer material. The tinting strength was evaluated by measuring the image density of the evaluation image. The image density was measured using an "X-Rite 404A Color Reflection Densitometer". The density of the solid image area was measured relative to a white background area that had an original density of 0.00. The density was measured on the solid image area at five points, i.e., the upper right, upper left, center, lower right, and lower left, and the evaluation was performed using the average value for the image density. The evaluation criteria are as follows.

A: the image density is at least 1.50 (very good tinting strength)

B: the image density is at least 1.35 but less than 1.50 (good tinting strength)

C: the image density is at least 1.25 but less than 1.35 (unproblematic tinting strength)

D: the image density is less than 1.25 (the tinting strength is inferior)

<Method for Evaluating the Low-Temperature Fixability>

A color laser printer (HP Color LaserJet 3525dn, from Hewlett-Packard) having a detached fixing unit was prepared, and the toner was removed from the cyan cartridge and the toner to be evaluated was loaded in its place. Then, using the loaded toner, an unfixed toner image (0.9 mg/cm$^2$) with a length of 2.0 cm and a width of 15.0 cm was formed on the image-receiving paper (Office Planner from Canon, Inc., 64 g/m$^2$) at the region 1.0 cm from the top edge with respect to the paper feed direction. The detached fixing unit was modified to enable adjustment of the fixation temperature and process speed, and using this a fixing test was carried out on the unfixed image.

In a normal-temperature, normal-humidity environment (23° C., 60% RH) and with the process speed set to 230 mm/s, the low-temperature fixing onset temperature was measured by carrying out fixing of the unfixed image at each 5° C. interval from 120° C. to 220° C. The low-temperature fixing onset temperature is defined at follows: at each temperature level, the fixed image density is measured and the image density is also measured after the fixed image has been rubbed five times with lens-cleaning paper under a load of 50 g/cm$^2$, and the low-temperature fixing onset temperature is defined as the fixing state for which the average value determined for the percentage reduction in the density reaches 10% or less.

The density was measured using an "X-Rite 404A Color Reflection Densitometer".

(Evaluation Criteria)

A: the low-temperature fixing onset temperature is equal to or less than 135° C. (the low-temperature fixability is particularly good)

B: the low-temperature fixing onset temperature is 140° C. or 145° C. (good low-temperature fixability)

C: the low-temperature fixing onset temperature is 150° C. or 155° C. (unproblematic low-temperature fixability)

D: the low-temperature fixing onset temperature is 160° C. or above (the low-temperature fixability is inferior)

<Method for Evaluating the Hot Offset Resistance>

The maximum fixation temperature was evaluated by producing fixed images as in the evaluation method described above. The maximum fixation temperature is defined as the highest temperature at which offset is not produced.

(Evaluation Criteria)

A: the maximum fixation temperature is equal to or greater than 205° C. (particularly good hot offset resistance)

B: the maximum fixation temperature is 195° C. or 200° C. (good hot offset resistance)

C: the maximum fixation temperature is 185° C. or 190° C. (unproblematic hot offset resistance)

D: the maximum fixation temperature is 180° C. or below (inferior hot offset resistance)

<Method for Evaluating the Transferability>

This evaluation was performed using "GF-R070 (A4, areal weight=66.0 g/m$^2$)" (commercially available from Canon Marketing Japan Inc.) as the evaluation paper.

Using 0.5 mg/cm$^2$ for the amount of toner laid on the paper surface in the solid area, 10,000 prints were output of an image in which the entire side of the paper was a solid area. Subsequent to this, again using 0.5 mg/cm$^2$ for the laid-on amount of toner, a single print was output of the image in which the entire side of the paper was a solid area; the amount of toner on the drum and the amount of toner on the transfer paper were measured; and the transfer efficiency was determined from the weight change (the transfer efficiency is 100% when the entire amount of toner on the drum is transferred onto the paper).

A: the transfer efficiency is at least 95% (very good transferability)

B: the transfer efficiency is at least 90% but less than 95% (good transferability)

C: the transfer efficiency is at least 80% but less than 90% (unproblematic transferability)

D: the transfer efficiency is less than 80% (inferior transferability)

Examples 1 to 39

The evaluations described above were carried out in Examples 1 to 39 using the following as the toner: black toner particles 1 to 22, magenta toner particles 1 to 8, yellow toners 1 to 6, and cyan toners 1 to 3. The results of the evaluations are given in Table 10.

Comparative Examples 1 to 4

The evaluations described above were carried out in Comparative Examples 1 to 4 using black toner particles 23 to 26 as the toner. The results of the evaluations are given in Table 10.

TABLE 10

| | | evaluations | | | | | | | |
|---|---|---|---|---|---|---|---|---|---|
| | | tinting strength | | low-temperature fixability | | hot offset resistance | | transferability | |
| example | toner | value | rank | value | rank | value | rank | value | rank |
| Example 1 | black toner particle 1 | 1.56 | A | 135 | A | 210 | A | 97 | A |
| Example 2 | magenta toner particle 1 | 1.54 | A | 135 | A | 210 | A | 97 | A |
| Example 3 | magenta toner particle 2 | 1.54 | A | 130 | A | 210 | A | 97 | A |
| Example 4 | yellow toner particle 1 | 1.53 | A | 135 | A | 210 | A | 97 | A |
| Example 5 | yellow toner particle 2 | 1.53 | A | 135 | A | 210 | A | 95 | A |
| Example 6 | yellow toner particle 3 | 1.53 | A | 135 | A | 210 | A | 95 | A |
| Example 7 | black toner particle 2 | 1.54 | A | 135 | A | 185 | C | 82 | C |
| Example 8 | black toner particle 3 | 1.50 | A | 130 | A | 195 | B | 95 | A |
| Example 9 | magenta toner particle 3 | 1.50 | A | 145 | B | 200 | B | 95 | A |
| Example 10 | magenta toner particle 4 | 1.50 | A | 145 | B | 200 | B | 95 | A |
| Example 11 | black toner particle 4 | 1.54 | A | 135 | A | 200 | B | 91 | B |
| Example 12 | black toner particle 5 | 1.50 | A | 135 | A | 205 | A | 96 | A |
| Example 13 | black toner particle 6 | 1.52 | A | 135 | A | 190 | C | 86 | C |
| Example 14 | black toner particle 7 | 1.33 | C | 135 | A | 205 | A | 97 | A |
| Example 15 | black toner particle 8 | 1.54 | A | 135 | A | 190 | C | 88 | C |
| Example 16 | black toner particle 9 | 1.49 | B | 145 | B | 200 | B | 95 | A |
| Example 17 | black toner particle 10 | 1.50 | A | 145 | B | 200 | B | 95 | A |
| Example 18 | black toner particle 11 | 1.51 | A | 145 | B | 200 | B | 95 | A |
| Example 19 | black toner particle 12 | 1.43 | B | 145 | B | 200 | B | 95 | A |
| Example 20 | black toner particle 13 | 1.47 | B | 145 | B | 200 | B | 95 | A |
| Example 21 | magenta toner particle 5 | 1.51 | A | 145 | B | 200 | B | 95 | A |
| Example 22 | magenta toner particle 6 | 1.51 | A | 135 | A | 185 | C | 82 | C |
| Example 23 | black toner particle 14 | 1.42 | B | 135 | A | 210 | A | 97 | A |
| Example 24 | cyan toner particle 1 | 1.45 | B | 135 | A | 195 | B | 93 | B |
| Example 25 | black toner particle 15 | 1.53 | A | 130 | A | 205 | A | 95 | A |
| Example 26 | black toner particle 16 | 1.53 | A | 135 | A | 210 | A | 98 | A |
| Example 27 | black toner particle 17 | 1.53 | A | 125 | A | 200 | B | 93 | B |
| Example 28 | black toner particle 18 | 1.53 | A | 140 | B | 210 | A | 97 | A |
| Example 29 | magenta toner particle 7 | 1.52 | A | 145 | B | 200 | B | 95 | A |
| Example 30 | magenta toner particle 8 | 1.52 | A | 140 | B | 205 | A | 96 | A |
| Example 31 | yellow toner particle 4 | 1.53 | A | 145 | B | 210 | A | 97 | A |
| Example 32 | yellow toner particle 5 | 1.53 | A | 130 | A | 205 | A | 95 | A |
| Example 33 | yellow toner particle 6 | 1.53 | A | 125 | A | 195 | B | 92 | B |
| Example 34 | black toner particle 19 | 1.50 | A | 145 | B | 200 | B | 90 | B |
| Example 35 | black toner particle 20 | 1.51 | A | 145 | B | 200 | B | 91 | B |
| Example 36 | black toner particle 21 | 1.38 | B | 145 | B | 195 | B | 91 | B |
| Example 37 | black toner particle 22 | 1.41 | B | 145 | B | 195 | B | 94 | B |
| Example 38 | cyan toner particle 2 | 1.46 | B | 145 | B | 200 | B | 95 | A |
| Example 39 | cyan toner particle 3 | 1.38 | B | 145 | B | 200 | B | 95 | A |
| comparative example 1 | black toner particle 23 | 1.23 | D | 135 | A | 175 | D | 75 | D |
| comparative example 2 | black toner particle 24 | 1.56 | A | 160 | D | 210 | A | 97 | A |
| comparative example 3 | black toner particle 25 | 1.53 | A | 140 | B | 180 | D | 77 | D |
| comparative example 4 | black toner particle 26 | 1.31 | C | 130 | A | 180 | D | 78 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-035616, filed Feb. 25, 2015, which is hereby incorporated by reference herein in its entirety.

What is claimed is:

1. A toner comprising a toner particle containing:

a binder system containing at least two different polymers, said binder system comprising (i) a binder resin and (ii) a crystalline polyester other than the binder resin;

a pigment; and a pigment dispersant, wherein the pigment dispersant comprises a structure represented by formula (1) and a polymer moiety, and a hydrophobic parameter HP1 of the pigment dispersant and a hydrophobic parameter HP2 of the crystalline polyester satisfy $-0.28 \leq (HP1-HP2) \leq 0.15$ where HP1 represents a volume fraction of heptane at a point of precipitation by the pigment dispersant as measured by the addition of heptane to a solution containing 0.05 mass parts of the pigment dispersant and 1.48 mass parts of chloroform, and HP2 represents a volume fraction of heptane at a point of precipitation by the crystalline polyester as measured by the addition of heptane to a solution containing 0.05 mass parts of the crystalline polyester and 1.48 mass parts of chloroform, (1)

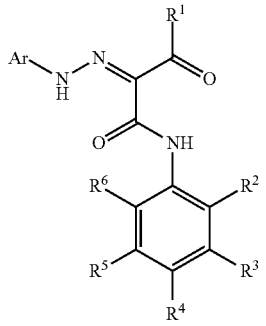

where $R^1$ represents a substituted or unsubstituted alkyl group or a substituted or unsubstituted phenyl group;

Ar represents a substituted or unsubstituted aryl group;

Ar and $R^2$ to $R^6$ satisfy at least one of (i) Ar has a linking group that is bonded to a carbon atom in the aryl group and that forms a linking portion of bond to the polymer moiety, or (ii) at least one of $R^2$ to $R^6$ is a linking group that forms a linking portion of bond to the polymer moiety;

each of the $R^2$ to $R^6$ that is not a linking group independently represents a hydrogen atom, a halogen atom, an alkyl group, an alkoxy group, a hydroxyl group, an amino group, a cyano group, a trifluoromethyl group, a carboxyl group, or a group represented by formula (2-1) or a group represented by formula (2-2); and Ar and $R^2$ to $R^6$ satisfy at least one of (iii) Ar has a group represented by formula (2-1) or a group represented by formula (2-2) as a substituent, or (iv) at least one of $R^2$ to $R^6$ is a group represented by formula (2-1) or a group represented by formula (2-2), (2-1)

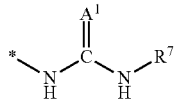

wherein in formula (2-1) * represents a site where the group bonds to the Ar or the aromatic ring having $R^2$ to $R^6$ in formula (1);

$R^7$ represents a hydrogen atom, a substituted or unsubstituted alkyl group, an aralkyl group, a substituted or unsubstituted alkyloxycarbonyl group, or a substituted or unsubstituted aralkyloxycarbonyl group;

$A^1$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group, (2-2)

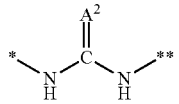

wherein in formula (2-2) * and ** each represent a site where the group bonds to the Ar or the aromatic ring having $R^2$ to $R^6$ in formula (1);

the group represented by formula (2-2) forms a 5-membered heterocycle by bonding with the Ar or the aromatic ring having $R^2$ to $R^6$ in formula (1);

$A^2$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group.

2. The toner according to claim 1, wherein the structure represented by formula (1) is represented by the following formula (3)

(3)

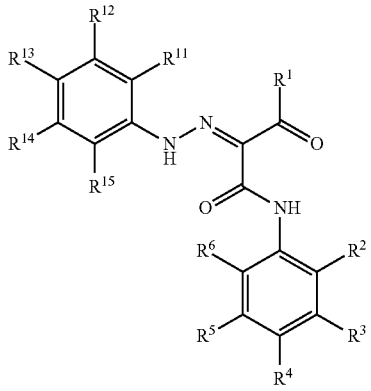

where $R^1$ represents a substituted or unsubstituted alkyl group or a substituted or unsubstituted phenyl group;

$R^{11}$ to $R^{15}$ and $R^2$ to $R^6$ satisfy at least one of (v) at least one of $R^{11}$ to $R^{15}$ is a linking group that forms a linking portion of bond to the polymer moiety, or (vi) at least one of $R^2$ to $R^6$ is a linking group that forms a linking portion of bond to the polymer moiety;

each of the $R^{11}$ to $R^{15}$ and $R^2$ to $R^6$ that is not a linking group independently represents a hydrogen atom, a halogen atom, an alkyl group, an alkoxy group, a hydroxyl group, an amino group, a cyano group, a trifluoromethyl group, a carboxyl group, a group represented by formula (2-1), or a group represented by formula (2-2); and $R^{11}$ to $R^{15}$ and $R^2$ to $R^6$ satisfy at least one of (vii) at least one of $R^{11}$ to $R^{15}$ is a group represented by the formula (2-1) or a group represented by formula (2-2), or (viii) at least one of $R^2$ to $R^6$ is a group represented by formula (2-1) or a group represented by formula (2-2).

3. The toner according to claim 1, wherein the pigment dispersant has in a molecule thereof a group represented by formula (4), and the number of groups represented by formula (4) per molecule of the pigment dispersant is from 2 to 10, (4)

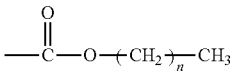

where n represents an integer from 3 to 21.

4. The toner according to claim 1, wherein the number of structures represented by formula (1) per molecule of the pigment dispersant is from 1 to 6.

5. The toner according to claim 1, wherein the polymer moiety has a monomer unit represented by formula (5), (5)

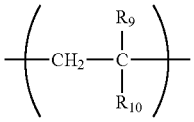

where $R_9$ represents the hydrogen atom or an alkyl group, and $R_{10}$ represents a substituted or unsubstituted phenyl group, a carboxyl group, a substituted or unsubstituted alkoxycarbonyl group, or a substituted or unsubstituted carboxamide group.

6. The toner according to claim 1, wherein the pigment comprises a pigment selected from the group consisting of carbon black; C. I. Pigment Yellow 74, 93, 139, 155, 180, and 185; and C. I. Pigment Red 31, 122, 150, 170, 258, and 269.

7. The toner according to claim 6, wherein the pigment comprises a pigment selected from the group consisting of carbon black; C. I. Pigment Yellow 155, 180, and 185; and C. I. Pigment Red 122 and 150.

8. The toner according to claim 1, wherein the crystalline polyester has a condensate of a dibasic acid monomer represented by formula (6) with a dihydric alcohol monomer represented by formula (7), $$HOOC—(CH_2)_m—COOH \quad (6)$$

wherein m is an integer from 4 to 12, $$HO—(CH_2)_n—OH \quad (7)$$

wherein n is an integer from 4 to 12.

9. The toner according to claim 1, wherein the crystalline polyester has a polyester segment and a polystyrene segment.

10. The toner according to claim 1, wherein the content of the crystalline polyester is from 0.5 to 20 mass % with respect to a total amount of the binder resin and the crystalline polyester.

11. The toner according to claim 1, wherein the content of the pigment dispersant is from 1.0 to 20 mass parts per 100 mass parts of the pigment.

12. The toner according to claim 1, wherein when the binder resin contains a styrene unit, the polymer moiety of the pigment dispersant contains a styrene unit, and when the binder resin contains a polyester unit, the polymer moiety of the pigment dispersant contains a polyester unit.

13. The toner according to claim 1, wherein Ar in formula (1) satisfies condition (iii).

14. The toner according to claim 1, wherein $R^2$ to $R^6$ in formula (1) satisfy condition (ii).

15. A method of producing a toner having a toner particle comprising a step of obtaining the toner particle by granulation in an aqueous medium, wherein the toner particle contains:

a binder system containing at least two different polymers, said binder system comprising (i) a binder resin and (ii) a crystalline polyester other than the binder resin;

a pigment; and a pigment dispersant, wherein the pigment dispersant comprises a structure represented by formula (1) and a polymer moiety, and a hydrophobic parameter HP1 of the pigment dispersant and a hydrophobic parameter HP2 of the crystalline polyester satisfy $-0.28 \leq (HP1-HP2) \leq 0.15$ where HP1 represents a volume fraction of heptane at a point of precipitation by the pigment dispersant as measured by the addition of heptane to a solution containing 0.05 mass parts of the pigment dispersant and 1.48 mass parts of chloroform, and HP2 represents a volume fraction of heptane at a point of precipitation by the crystalline polyester as measured by the addition of heptane to a solution containing 0.05 mass parts of the crystalline polyester and 1.48 mass parts of chloroform, (1)

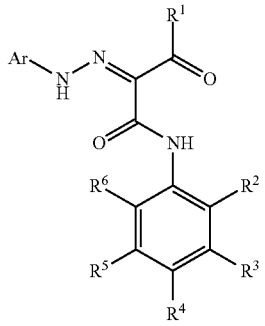

where $R^1$ represents a substituted or unsubstituted alkyl group or a substituted or unsubstituted phenyl group;

Ar represents a substituted or unsubstituted aryl group;

Ar and $R^2$ to $R^6$ satisfy at least one of (i) Ar has a linking group that is bonded to a carbon atom in the aryl group and that forms a linking portion of bond to the polymer moiety, or (ii) at least one of $R^2$ to $R^6$ is a linking group that forms a linking portion of bond to the polymer moiety;

each of the $R^2$ to $R^6$ that is not a linking group independently represents a hydrogen atom, a halogen atom, an alkyl group, an alkoxy group, a hydroxyl group, an amino group, a cyano group, a trifluoromethyl group, a carboxyl group, or a group represented by formula (2-1) or a group represented by formula (2-2); and Ar and $R^2$ to $R^6$ satisfy at least one of (iii) Ar has a group represented by formula (2-1) or a group represented by formula (2-2) as a substituent, or (iv) at least one of $R^2$ to $R^6$ is a group represented by formula (2-1) or a group represented by formula (2-2), (2-1)

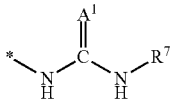

wherein in formula (2-1) * represents a site where the group bonds to the Ar or the aromatic ring having $R^2$ to $R^6$ in formula (1);

$R^7$ represents a hydrogen atom, a substituted or unsubstituted alkyl group, an aralkyl group, a substituted or unsubstituted alkyloxycarbonyl group, or a substituted or unsubstituted aralkyloxycarbonyl group;

$A^1$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group, (2-2)

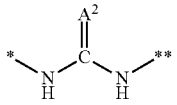

wherein in formula (2-2) * and ** each represent a site where the group bonds to the Ar or the aromatic ring having $R^2$ to $R^6$ in formula (1);

the group represented by formula (2-2) forms a 5-membered heterocycle by bonding with the Ar or the aromatic ring having $R^2$ to $R^6$ in formula (1);

$A^2$ represents an oxygen atom, a sulfur atom, or an $NR^8$ group; and $R^8$ represents a hydrogen atom, a substituted or unsubstituted alkyloxycarbonyl group, or a substituted or unsubstituted aralkyloxycarbonyl group.

16. The toner according to claim 1, wherein the binder resin is a styrenic vinyl resin, maleic acid copolymer, polyester resin, or epoxy resin.

17. The toner according to claim 1, wherein the binder resin is a styrenic vinyl resin, maleic acid copolymer, noncrystalline polyester resin, or epoxy resin.

* * * * *